US011603121B2

(12) United States Patent
Jones et al.

(10) Patent No.: US 11,603,121 B2
(45) Date of Patent: Mar. 14, 2023

(54) HOPPER RAILROAD CAR FLEXIBLE TOP HATCH COVER

(71) Applicant: Gunderson LLC, Portland, OR (US)

(72) Inventors: Peter L. Jones, Southlake, TX (US); James A. Warwick, North Richland Hills, TX (US); Michael Tadros, Arlington, TX (US)

(73) Assignee: Gunderson LLC, Portland, OR (US)

( * ) Notice: Subject to any disclaimer, the term of this patent is extended or adjusted under 35 U.S.C. 154(b) by 438 days.

(21) Appl. No.: 16/743,743

(22) Filed: Jan. 15, 2020

(65) Prior Publication Data

US 2021/0213981 A1 Jul. 15, 2021

(51) Int. Cl.

| | |
|---|---|
| ***B61D 39/00*** | (2006.01) |
| ***B65D 90/00*** | (2006.01) |
| *B61D 7/00* | (2006.01) |

(52) U.S. Cl.

CPC ..... *B61D 39/006* (2013.01); *B61D 5/08* (2013.01); *B61D 39/001* (2013.01); *B61D 7/00* (2013.01)

(58) Field of Classification Search

CPC . B61D 5/08; B61D 7/00; B61D 17/12; B61D 17/16; B61D 39/00; B61D 39/001; B61D 39/002; B61D 39/005; B61D 39/006; B61D 39/007; B61D 39/008; B61D 49/00

See application file for complete search history.

(56) References Cited

U.S. PATENT DOCUMENTS

| | | | | |
|---|---|---|---|---|
| 1,776,168 A | | 9/1930 | Sweeley et al. | |
| 2,239,033 A | | 4/1941 | Cartmill | |
| 3,190,238 A | | 6/1965 | Carney et al. | |
| 3,224,491 A | | 12/1965 | Wallace | |
| 3,348,602 A | | 10/1967 | Bertil | |
| 3,707,919 A | | 1/1973 | Adler | |
| 3,796,168 A | | 3/1974 | Zeller | |
| 4,040,363 A | | 8/1977 | Walk et al. | |
| 4,239,008 A | | 12/1980 | Conlon | |
| 4,245,565 A | * | 1/1981 | Stark | F16J 15/027 220/849 |
| 4,248,160 A | | 2/1981 | Carney et al. | |
| 4,376,542 A | | 3/1983 | Hennessy | |
| 4,452,150 A | | 6/1984 | Dominguez | |

(Continued)

FOREIGN PATENT DOCUMENTS

| | | |
|---|---|---|
| BR | 102014028426 A2 | 9/2016 |
| DE | 3721146 A1 | 1/1989 |

OTHER PUBLICATIONS

"Extended European Search Report", from corresponding European Patent Application No. 21150891.6 (8 pages), dated Jun. 2, 2021.

*Primary Examiner* — S. Joseph Morano

*Assistant Examiner* — Cheng Lin

(74) *Attorney, Agent, or Firm* — Neal, Gerber & Eisenberg LLP

(57) ABSTRACT

A hopper railroad car hatch cover including an elongated movable flexible hatch including an elongated flexible panel and an elongated magnetic coaming sealer connected to the bottom of the elongated movable flexible panel, wherein the elongated magnetic coaming sealer is configured, such that when the elongated movable hatch of the hatch cover is in the closed position on a coaming of a hopper railroad car, the elongated magnetic coaming sealer engages and creates a seal with the coaming.

21 Claims, 20 Drawing Sheets

(56) References Cited

U.S. PATENT DOCUMENTS

| | | | | |
|---|---|---|---|---|
| 4,638,743 | A * | 1/1987 | Loomis | B61D 7/00 105/396 |
| 4,840,126 | A | 6/1989 | Kleykamp | |
| 5,311,824 | A * | 5/1994 | Sauer | B61D 39/001 105/377.01 |
| 5,785,362 | A | 7/1998 | Nadherny | |
| 6,827,025 | B2 | 12/2004 | Gaydos et al. | |
| 7,823,515 | B2 | 11/2010 | Schaefer et al. | |
| 8,056,486 | B2 | 11/2011 | Haymond et al. | |
| 8,631,746 | B2 | 1/2014 | Knight et al. | |
| 8,701,565 | B2 * | 4/2014 | Creighton | B61D 39/001 105/377.01 |
| 8,826,827 | B1 | 9/2014 | Dimmer et al. | |
| 9,783,212 | B2 * | 10/2017 | Gibney | B61D 3/00 |
| 10,035,521 | B2 | 7/2018 | Williams | |
| 2008/0029011 | A1 | 2/2008 | Czarnowski et al. | |
| 2010/0258032 | A1 | 10/2010 | Haymond et al. | |
| 2010/0307374 | A1 * | 12/2010 | Kalal | B61D 39/00 105/377.01 |
| 2012/0048140 | A1 | 3/2012 | Dial et al. | |
| 2012/0152146 | A1 | 6/2012 | Blankenship | |
| 2013/0020829 | A1 * | 1/2013 | Smith | B60J 7/102 296/100.18 |
| 2017/0225694 | A1 | 8/2017 | Sandheinrich et al. | |
| 2019/0112867 | A1 | 4/2019 | Warren | |
| 2019/0161096 | A1 | 5/2019 | Warren | |
| 2021/0046955 | A1 | 2/2021 | Jones et al. | |

* cited by examiner

HOPPER RAILROAD CAR FLEXIBLE TOP HATCH COVER

BACKGROUND

The railroad industry employs a variety of different railroad cars for transporting different materials. For example, various known hopper railroad cars often carry bulk materials such as grain, and are sometimes call "hopper cars." Known hopper cars often include one or more openable top hatches that seal the top of the hopper car (when the hopper car is not being loaded) to protect the materials in the hopper car from the elements and other external sources. Various known hopper cars also include one or more discharge chutes at the bottom of the hopper car for unloading the materials from the hopper car. Various known hopper cars include one or more compartments, and may include one or more internal walls that provide structure to the hopper car and that direct the materials in the hopper car toward the discharge chute(s). To load various known hopper cars, the hopper car is positioned underneath a material loading assembly, and the top hatch(es) are opened. Opening the top hatch(es) often require(s) specialized machinery and/or a worker to be physically present on the top of the hopper car to open the top hatch(es).

There is a continuing to provide improved hopper railroad cars, such as hopper railroad cars that have one or more improved top hatches that improve the material loading process.

SUMMARY

Various embodiments of the present disclosure provide an improved top hatch cover for a hopper car. Various embodiments of the present disclosure provide a hopper car with an improved top hatch cover.

More specifically, in various example embodiments of the present disclosure, the top hatch cover is partially flexible and includes an elongated movable flexible hatch. a plurality of spaced apart central hinges connected to the hatch, a first end hinge connected to a first end of the hatch, a second end hinge connected to an opposite second end of the hatch, a first actuator connected to the first end hinge and connectable to a roof of a hopper railroad car, and a second actuator connected to the second end hinge and connectable to the roof of the hopper railroad car. The elongated movable flexible hatch includes an elongated flexible panel and an elongated magnetic coaming sealer connected to the bottom of the elongated movable flexible panel. The elongated movable flexible panel is larger than an upwardly extending coaming of the roof of the hopper car, and larger than an opening in the roof of the hopper car partially defined by the coaming. The elongated magnetic coaming sealer includes a ring suitably attached to the bottom of the elongated flexible panel. The magnetic coaming sealer is configured, such that when the elongated movable hatch of the hatch cover is in the closed position on the coaming, the elongated magnetic coaming sealer engages and creates a seal with the coaming. The actuators are configured to open the hatch cover from either or both ends. Each actuator can lift the respective end of the elongated movable flexible hatch to cause a sequential lifting of the hatch including the elongated magnetic coaming sealer from the coaming in sequential sections from that end. This process in effect causes an unpeeling of the hatch of the hatch cover from the coaming. Both actuators can cause this to occur simultaneously from both ends of the hatch cover such that the unpeeling effect meets in the middle of the hatch and such that the central section of the hatch cover is the last section to be lifted (or unpeeled) from the coaming.

Other objects, features, and advantages of the present disclosure will be apparent from the following detailed disclosure, taken in conjunction with the accompanying sheets of drawings, wherein like reference numerals refer to like parts.

2 shown attached to the second end of the roof of the hopper car, shown in the closed position, and shown with the second actuator of the hatch cover.

Figure 1:
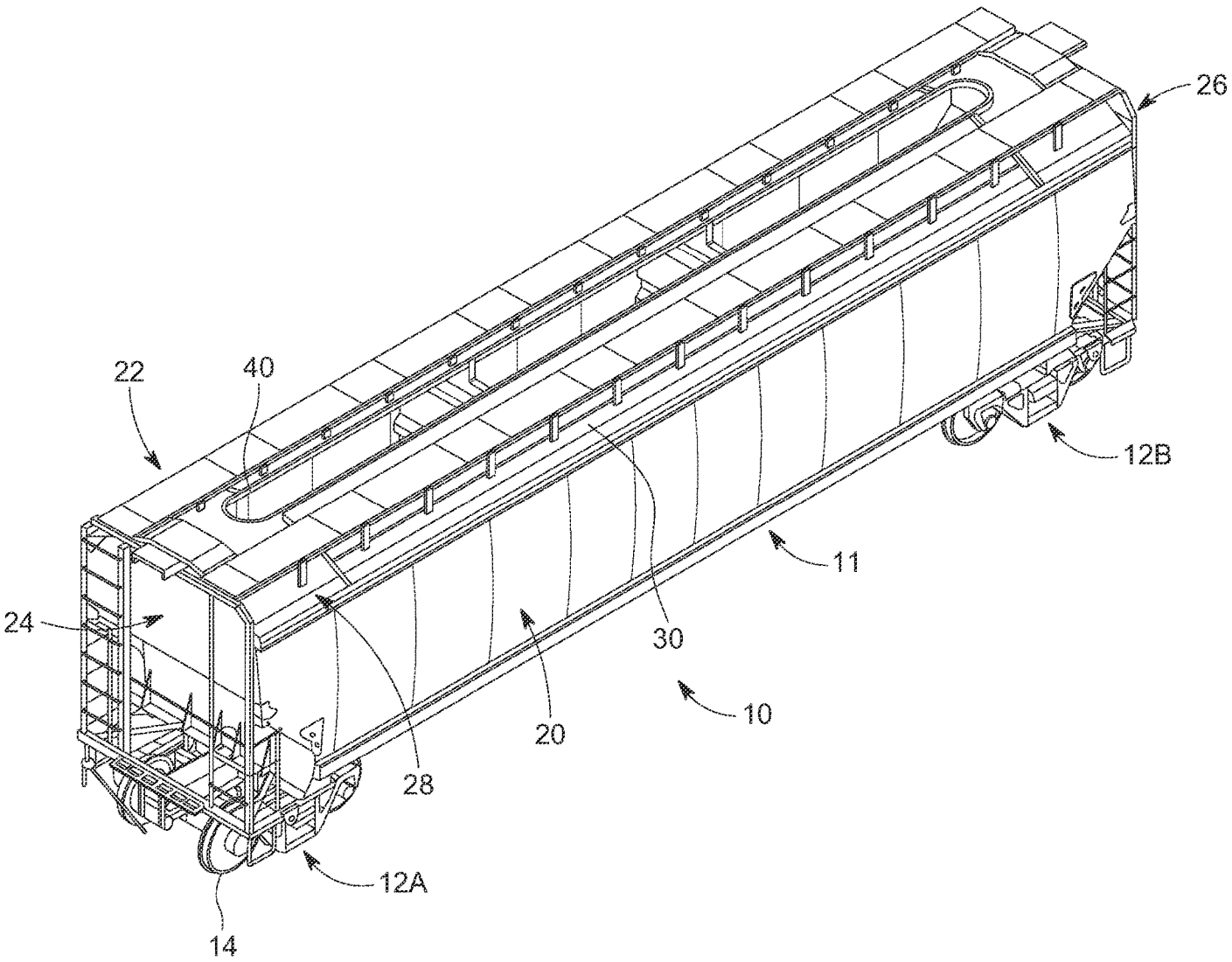
FIG. 1 is a top perspective view of a hopper car of the present disclosure that is configured to transport a variety of bulk materials, shown without the top hatch cover of the present disclosure.
Figure 2:
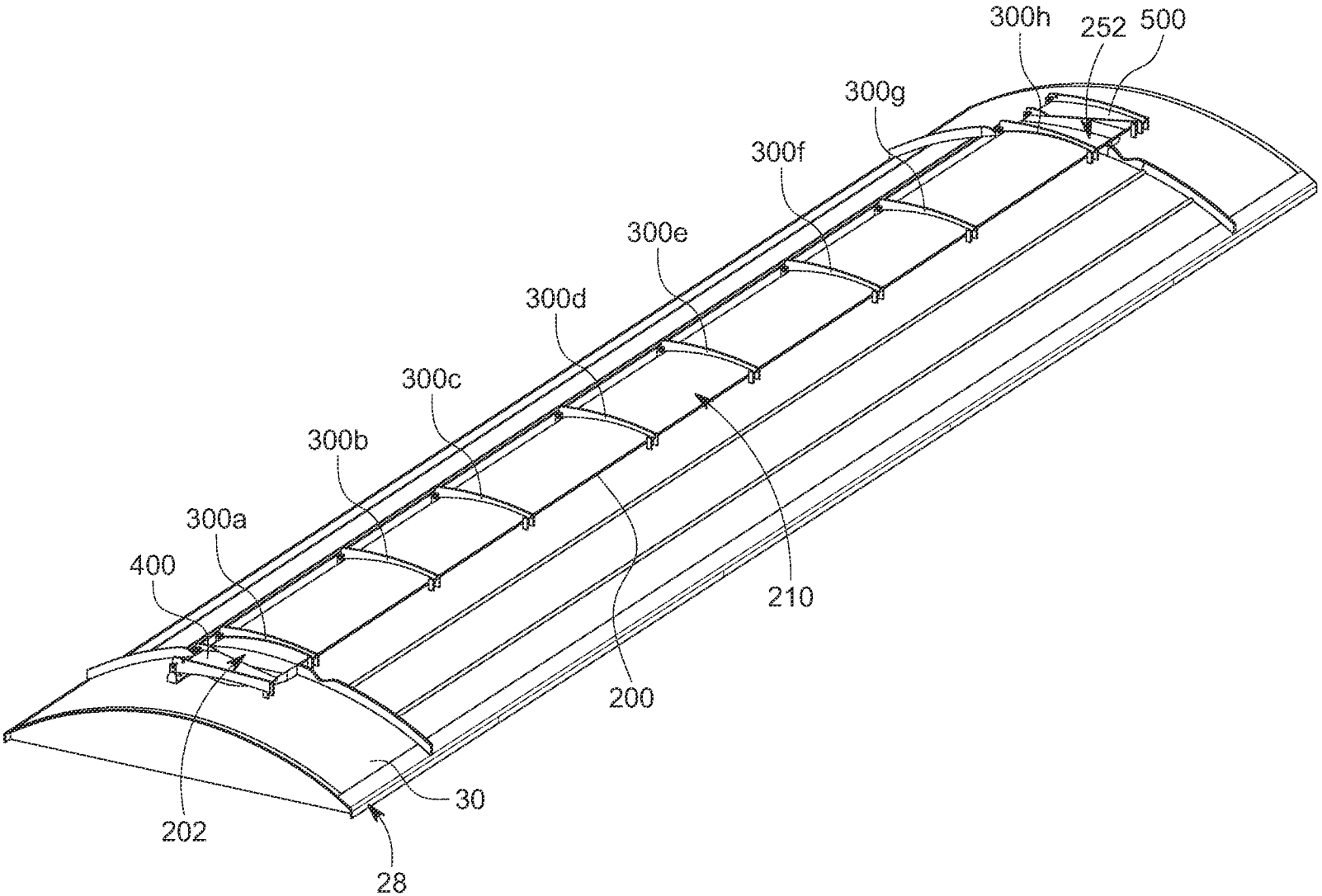
FIG. 2 is an enlarged top perspective view of the roof of the hopper car of FIG. 1, a top hatch cover of one example embodiment of the present disclosure shown attached to the roof of the hopper car, shown in the closed position, and shown without the actuators of this example hatch cover for clarity.
Figure 3:
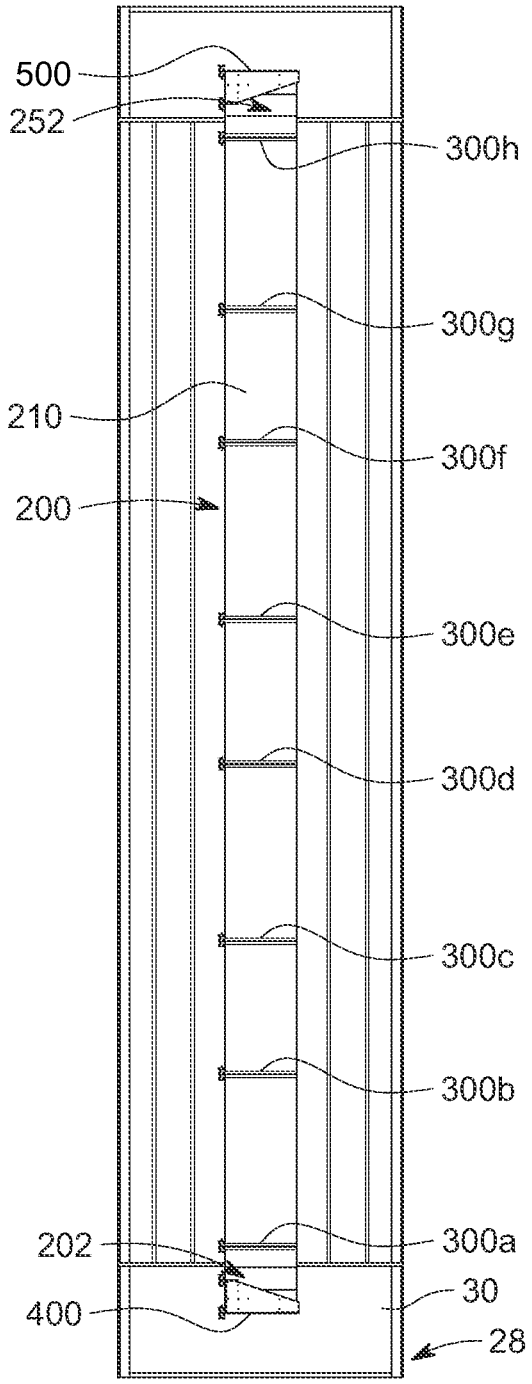
FIG. 3 is a top view of the roof of the hopper car of FIG. 1, and the top hatch cover of FIG. 2 shown attached to the roof of the hopper car, shown in the closed position, and shown without the actuators of the hatch cover for clarity.
Figure 4:
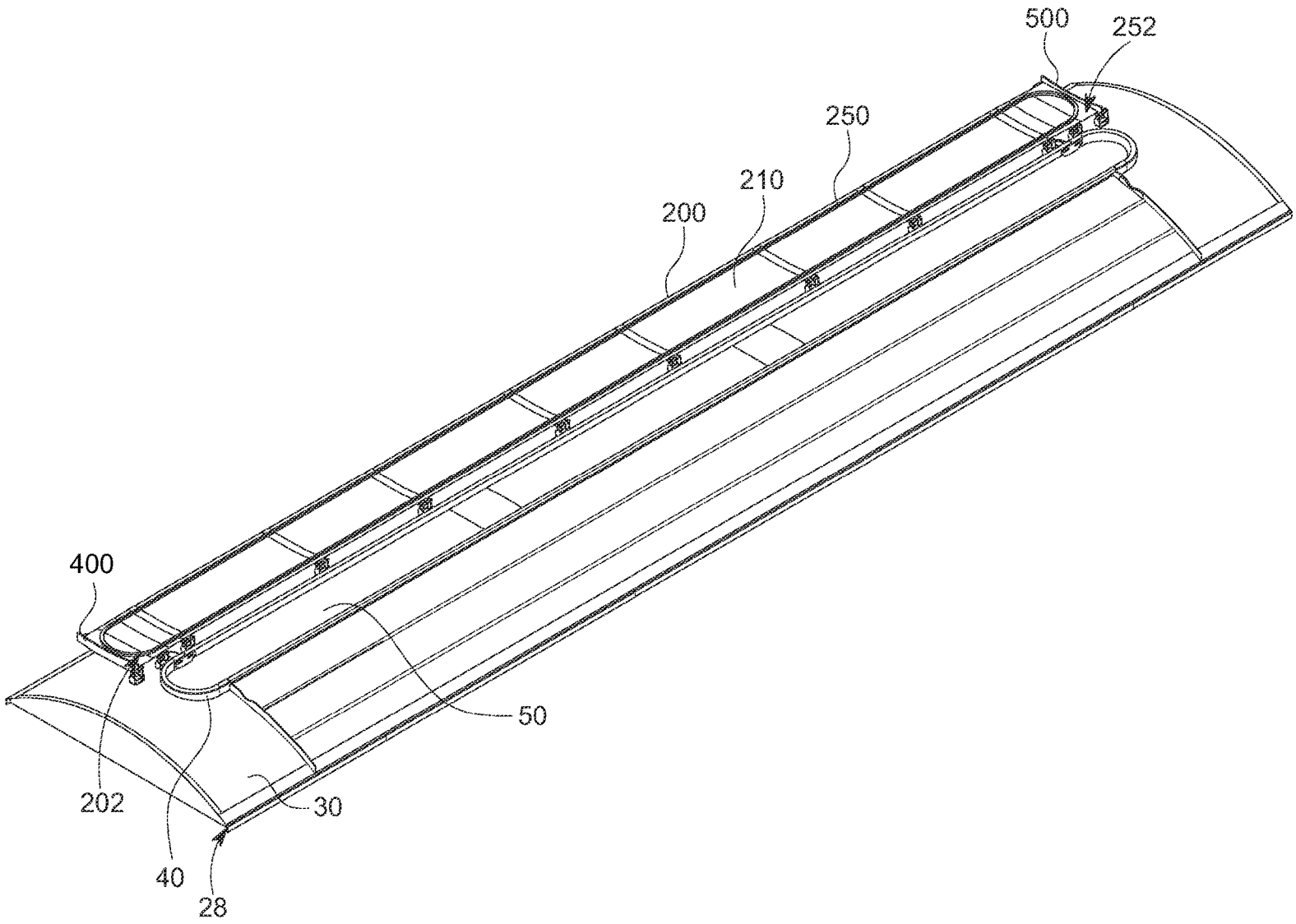
FIG. 4 is a top perspective view of the roof of the hopper car of FIG. 1, and the top hatch cover of FIG. 2 shown attached to the roof of the hopper car, shown in the fully open position, and shown without the actuators of the hatch cover for clarity.
Figure 5:
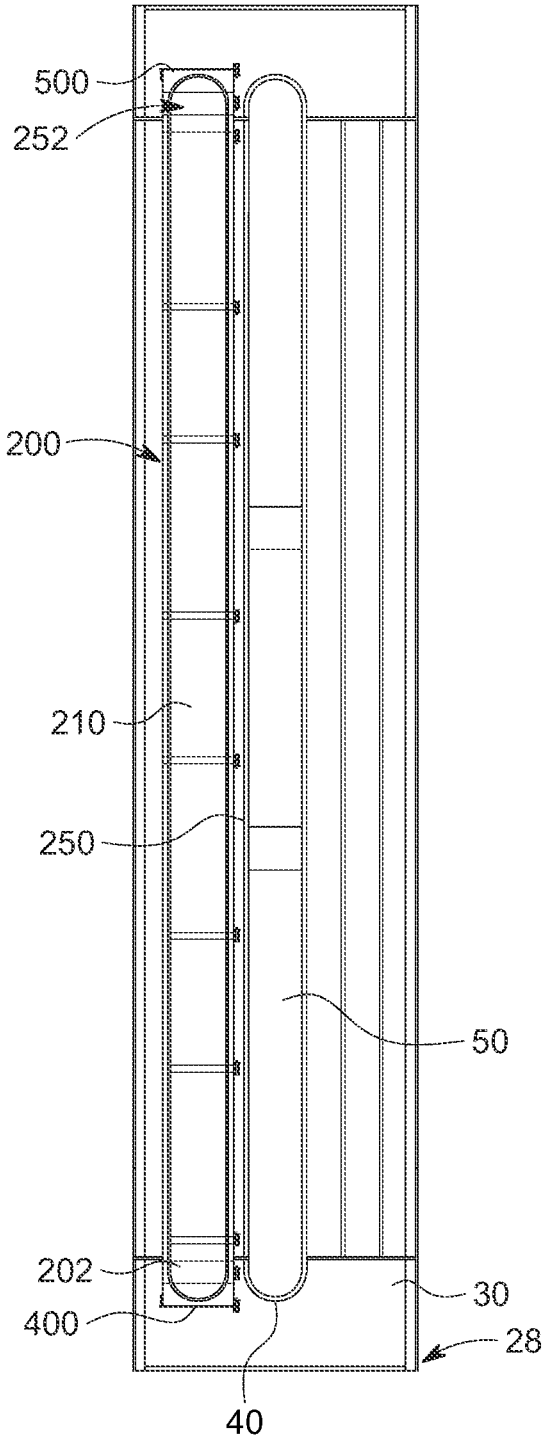
FIG. 5 is a top view of the roof of the example hopper car of FIG. 1, and the top hatch cover of FIG. 2 shown attached to the roof of the hopper car, shown in the open position, and shown without the actuators of the hatch cover for clarity.
Figure 6:
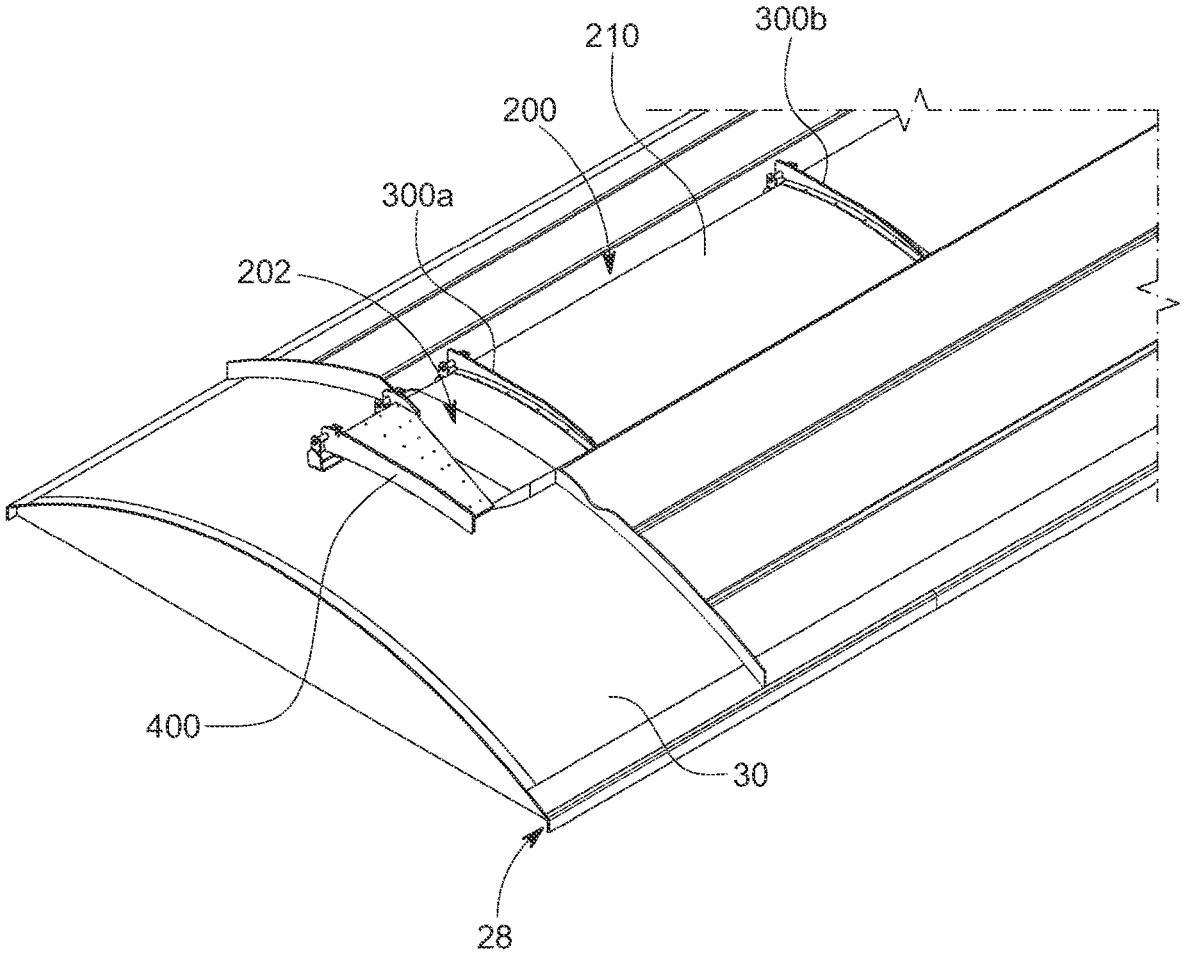
FIG. 6 is a further enlarged fragmentary top perspective view of a first end of the roof of the example hopper car of FIG. 1, and a first end of the top hatch cover of FIG. 2 shown attached to the first end of the roof of the hopper car, shown in the closed position, and shown without the first actuator of the hatch cover for clarity.
Figure 7:
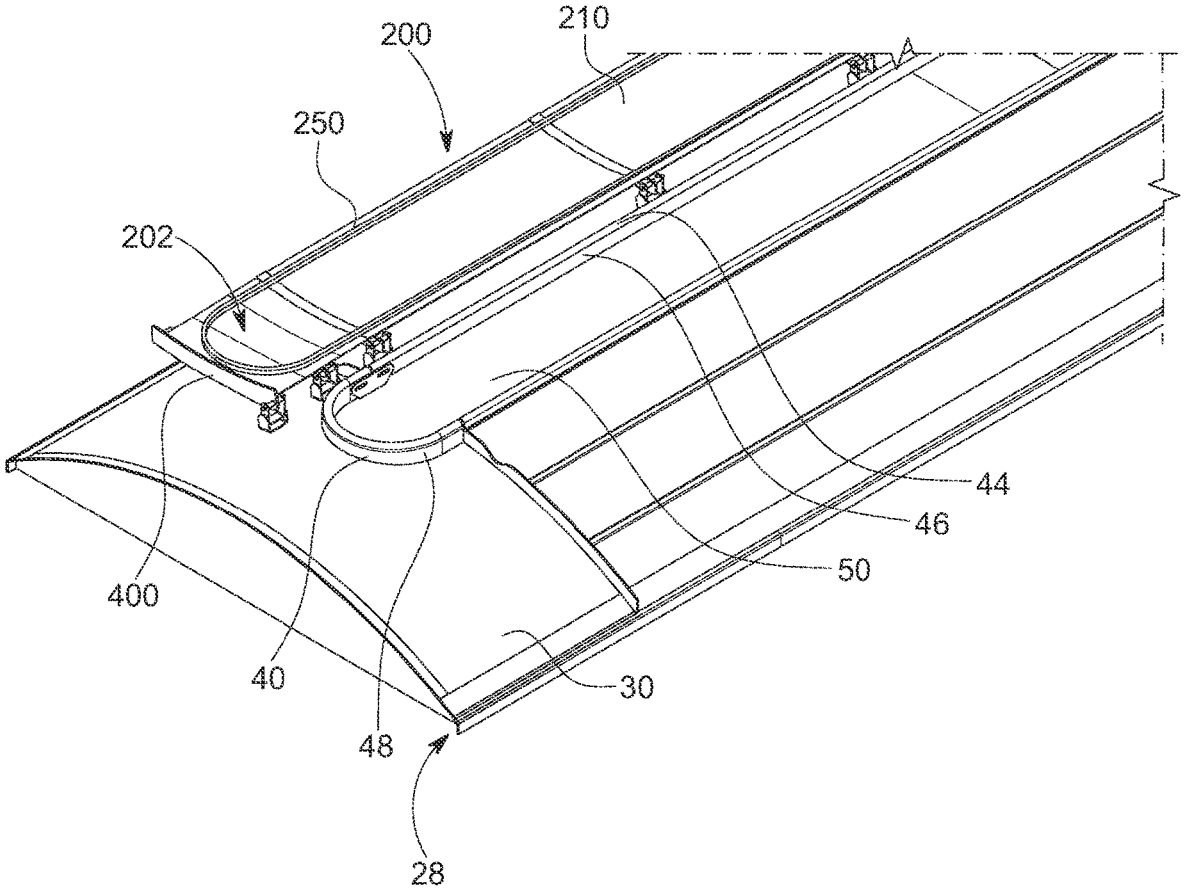
FIG. 7 is a further enlarged fragmentary top perspective view of the first end of the roof of the example hopper car of FIG. 1, and the first end of the top hatch cover of FIG. 2 shown attached to the first end of the roof of the hopper car, shown in the fully open position, and shown without the first actuator of the hatch cover for clarity.
Figure 8:
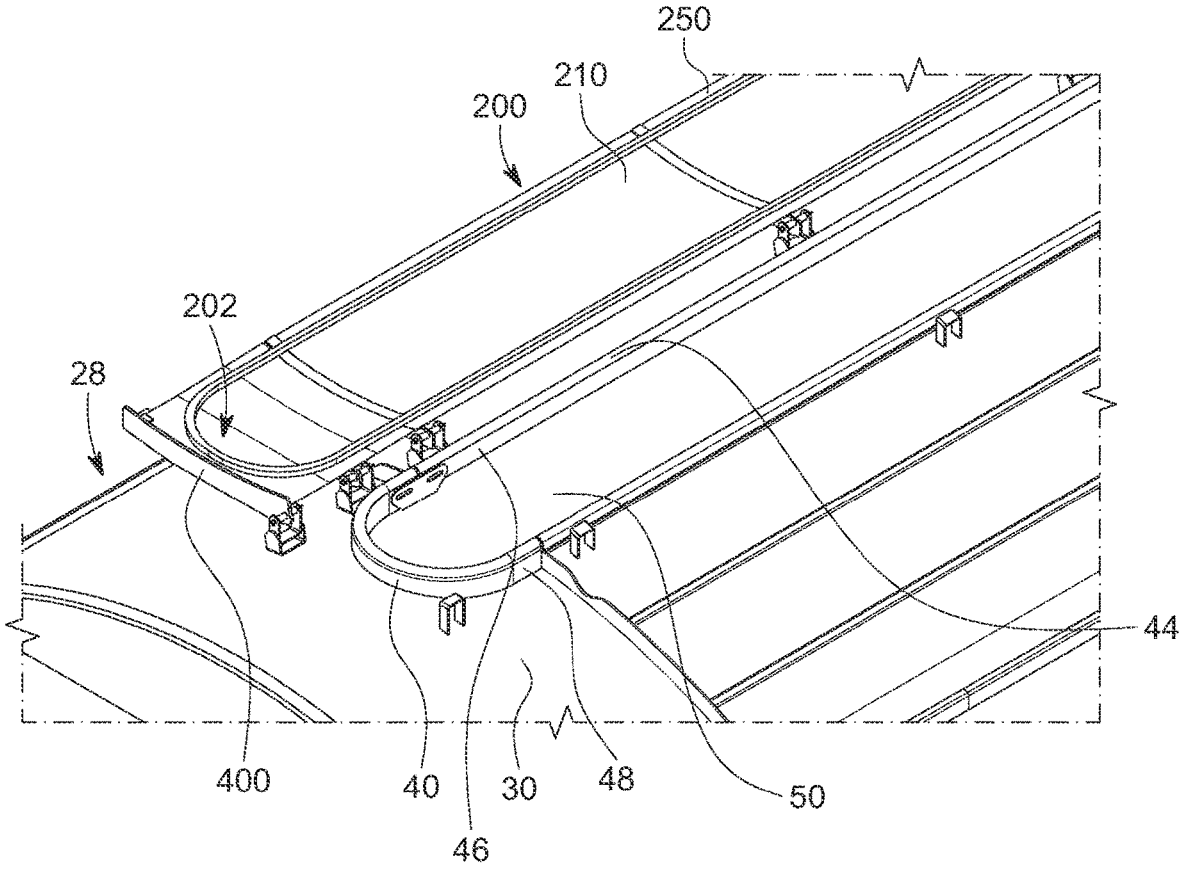
FIG. 8 is an even further enlarged fragmentary top perspective view of the first end of the roof of the example hopper car of FIG. 1, and the first end of the top hatch cover of FIG. 2 shown attached to the first end of the roof of the hopper car, shown in the fully open position, and shown without the first actuator of the hatch cover for clarity.
Figure 12:
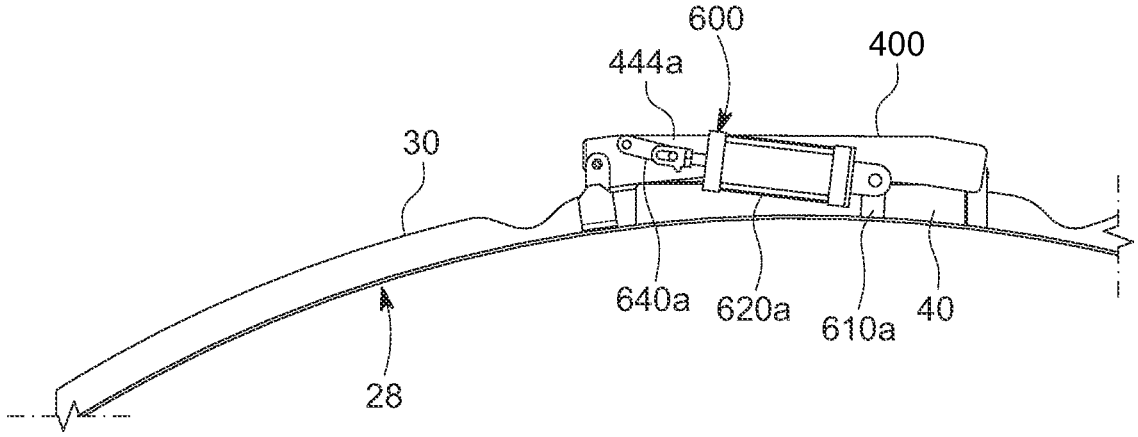

FIG. 12 is an enlarged fragmentary end view of the first end of the roof of the example hopper car of FIG. 1, and the first end of the hatch cover of FIG. 2 shown attached to the first end of the roof of the hopper car, and shown without the first actuator of the hatch cover in the closed position.

Figure 13:
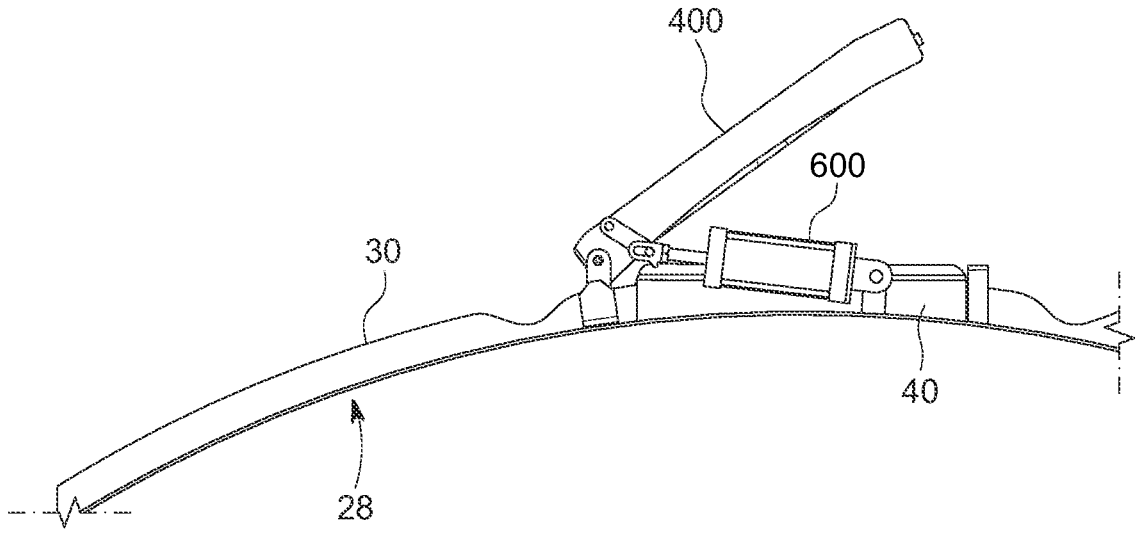

FIG. 13 is an enlarged fragmentary end view of the first end of the roof of the example hopper car of FIG. 1, and the first end of the top hatch cover of FIG. 2 shown attached to the first end of the roof of the hopper car, and shown with the first actuator of the hatch cover in a first partially open position.

Figure 14:
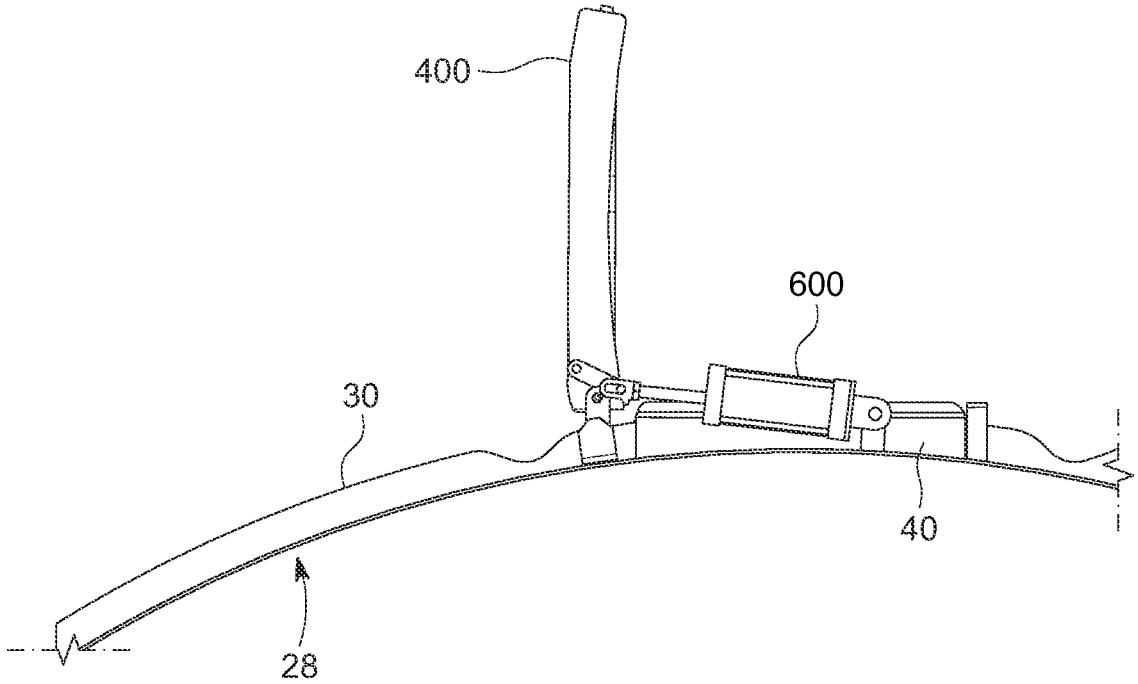

FIG. 14 is an enlarged fragmentary end view of the first end of the roof of the example hopper car of FIG. 1, and the first end of the top hatch cover of FIG. 2 shown attached to the first end of the roof of the hopper car, and shown with the first actuator of the hatch cover in a second partially open position.

Figure 15:
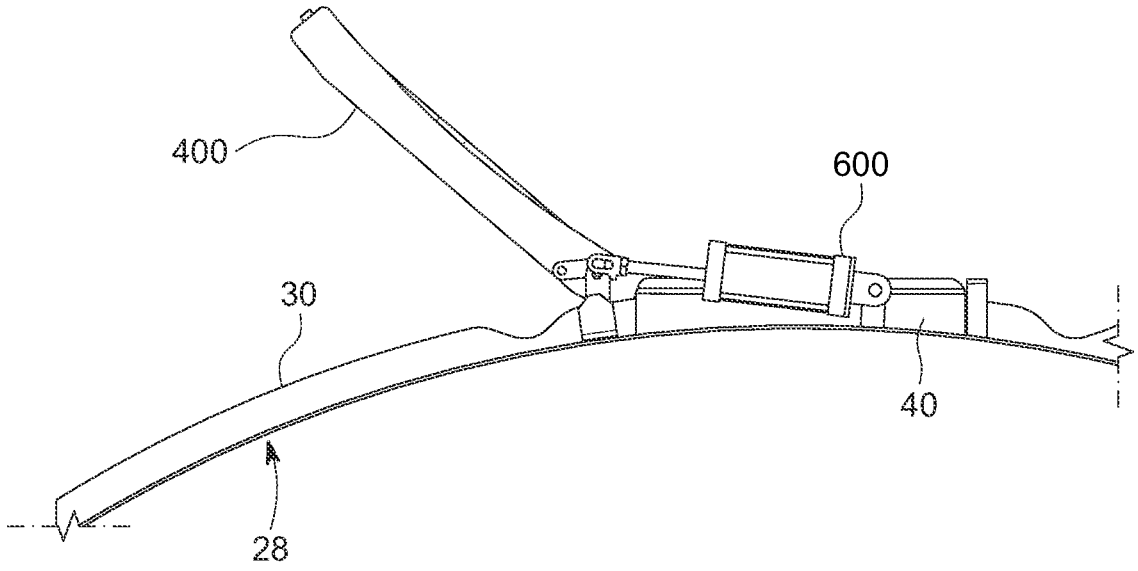

FIG. 15 is an enlarged fragmentary end view of the first end of the roof of the example hopper car of FIG. 1, and the first end of the top hatch cover of FIG. 2 shown attached to the first end of the roof of the hopper car, and shown with the first actuator of the hatch cover in a third partially open position.

Figure 16:
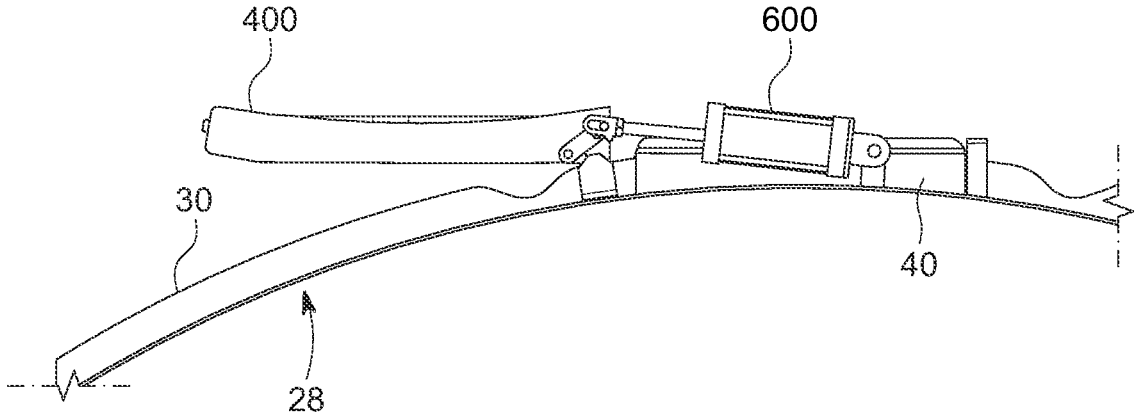

FIG. 16 is an enlarged fragmentary end view of the first end of the roof of the example hopper car of FIG. 1, and the first end of the top hatch cover of FIG. 2 shown attached to the first end of the roof of the hopper car, and shown with the first actuator of the hatch cover in a fully open position.

Figure 17:
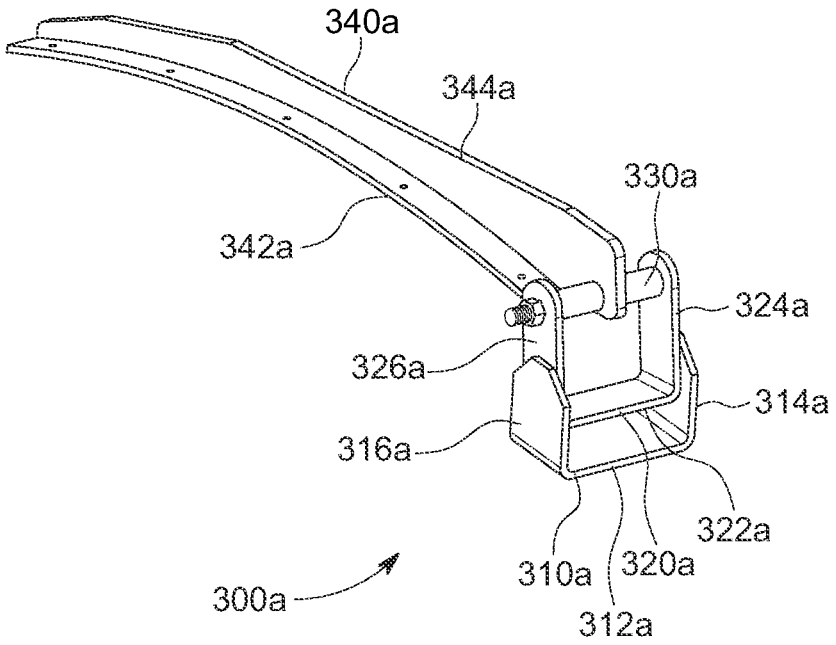

FIG. 17 is an enlarged top perspective view of one of the central hinges of the top hatch cover of FIG. 2, shown removed from the hatch cover of FIG. 2.

Figure 18:
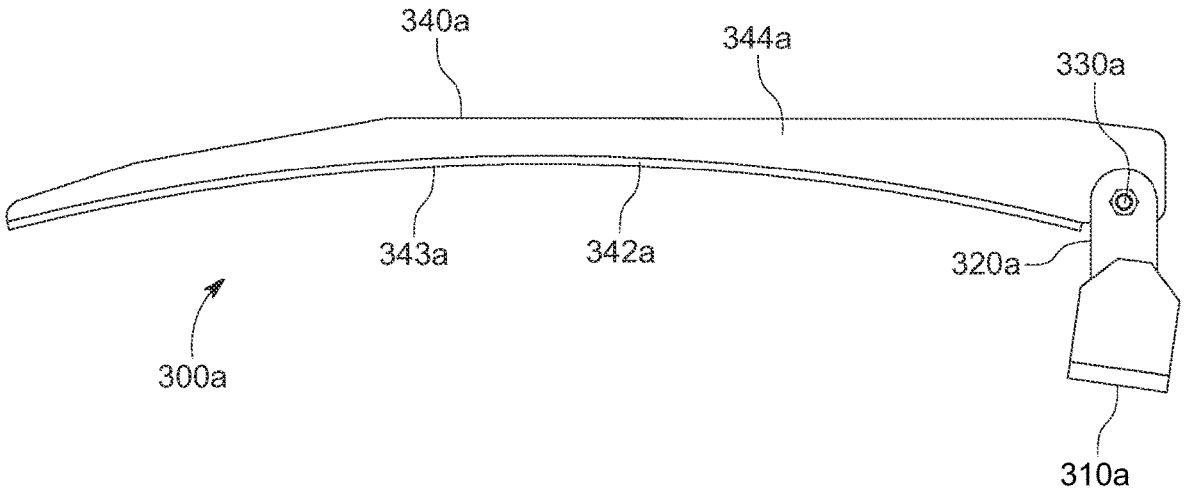

FIG. 18 is an enlarged side view of the central hinge of FIG. 17 of the top hatch cover of FIG. 2, shown removed from the hatch cover of FIG. 2.

Figure 19:
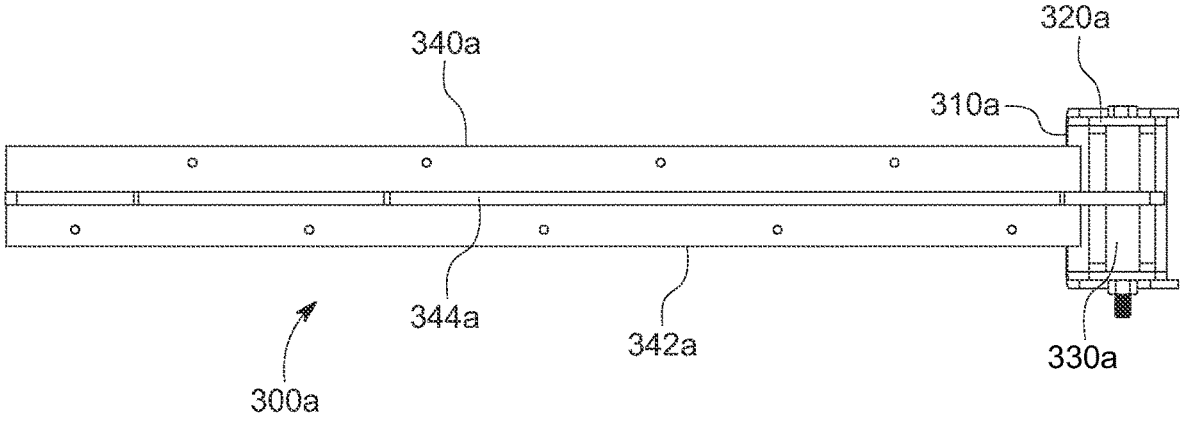

FIG. 19 is an enlarged top view of the central hinge of FIG. 17 of the top hatch cover of FIG. 2, shown removed from the hatch cover of FIG. 2.

Figure 20:
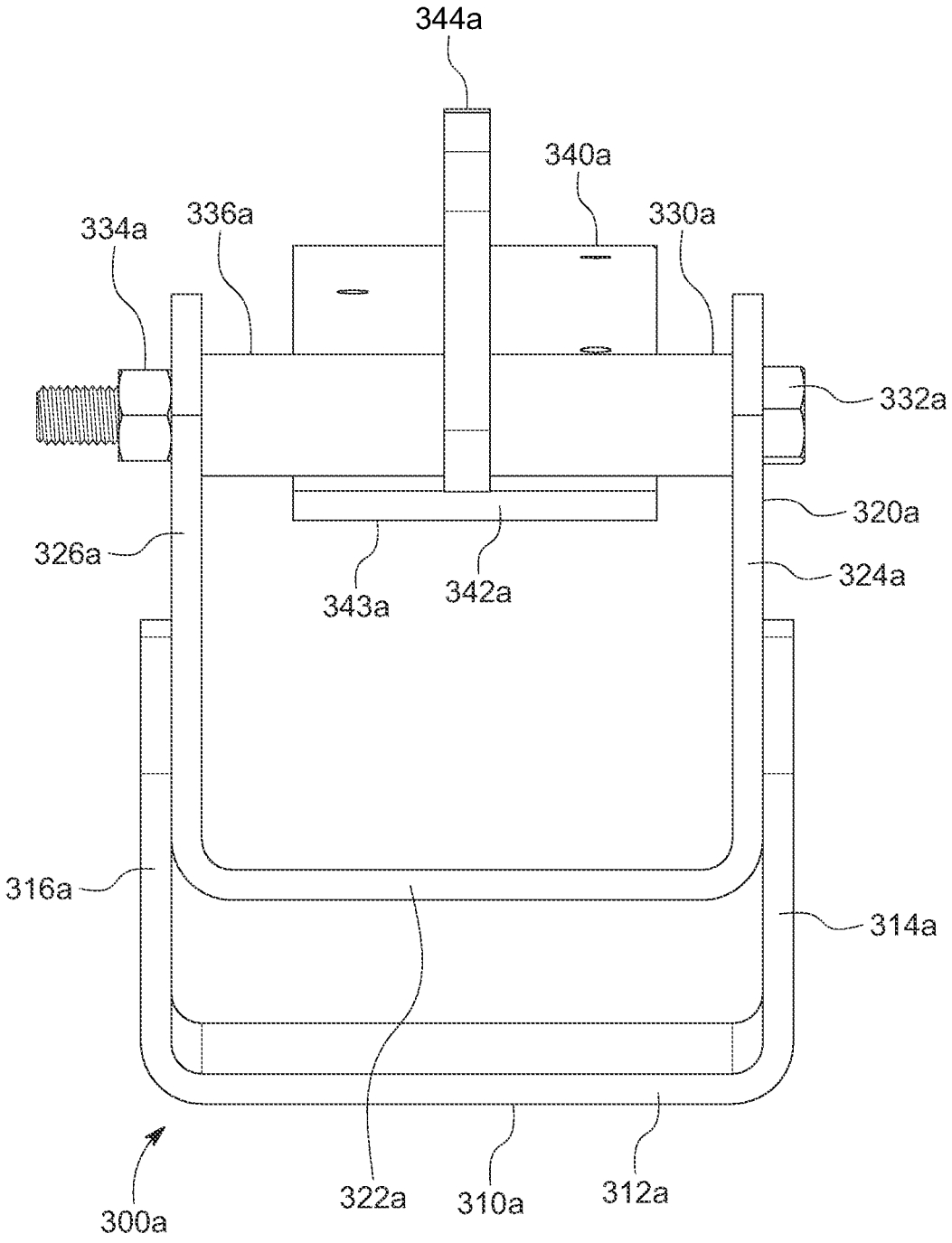

FIG. 20 is an enlarged end view of the central hinge of FIG. 17 of the top hatch cover of FIG. 2, shown removed from the hatch cover of FIG. 2.

DETAILED DESCRIPTION

While the features, devices, and apparatus described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, and the like, are not intended to be limited to direct mounting methods but should be interpreted broadly to include indirect and operably coupled, mounted, connected and like mounting methods. This specification is intended to be taken as a whole and interpreted in accordance with the principles of the present disclosure and as understood by one of ordinary skill in the art.

Various embodiments of the present disclosure provide a top hatch cover for a railroad hopper car that is partially flexible and that automatically opens and closes. The top hatch cover facilitates automatic opening and closing without requiring specialized machinery. The top hatch cover of the present disclosure also eliminates the need for a person to be physically present on roof of the hopper car to open and close the hatch cover for the loading materials into the hopper car.

Referring now to the drawings, FIGS. 1 to 16 partially illustrate an example hopper car 10 having a roof 28 to which the top hatch cover of the present disclosure can be attached. The illustrated example hopper car 10 generally includes: (1) a frame 11; (2) spaced apart trucks 12A and 12B configured to support the frame 11; (3) a plurality of wheels (such as wheel 14) that support the trucks; (4) a first side wall 20 connected to and supported by the frame 11; (5) a second side wall 22 connected to and supported by the frame 11; (6) a first end wall 24 connected to and supported by the frame 11; (7) a second end wall 26 connected to and supported by the frame 11; and (8) a roof 28 connected to and supported by the side walls, the end walls, and the frame. The first and second side walls are spaced apart. The first and second end walls are also spaced apart. The hopper car 10 generally includes a first end and a second end. The frame, the side walls, the end walls, and the roof define one or more interior compartments. It should be appreciated that the configuration and size of the hopper car may vary in accordance with the present disclosure.

As also further seen in FIGS. 2 to 16, in this illustrated example embodiment, the roof 28 generally includes: (1) a curved panel 30; and (2) a coaming 40 integrally connected to, supported by and upwardly extending from the curved panel 30.

The curved panel 30 is connected to and supported by the side walls 20 and 22 and the end walls 24 and 26 of the hopper car 10. The curved panel 30 is elevated in the middle (from side to side), such that the panel 30 is higher in the middle and is lower at the respective connection points or edges at the respective side walls 20 and 22. This enables the curved panel 30 to deflect rain, snow, and other objects off the roof 28 of the hopper car 10. The curved panel 30 may be made from steel, or any other suitable ferromagnetic material. The curved panel 30 is illustrated as having a symmetrical curvature. However, it should be appreciated that the curvature may be asymmetrical in accordance with the present disclosure. It should also be appreciated that the roof 28 may alternatively include a flat (i.e., not curved) panel, a panel including one or more sharp bends rather than a gradual curve, or a panel having a curvature different from that shown in the Figures in accordance with the present disclosure. In addition, the roof 28 may include a single panel or multiple panels connected together in accordance with the present disclosure.

The coaming 40 generally includes an oval upright portion 42 having a top surface 44, an inner surface 46, and an outer surface 48. The coaming 40 defines an oval or obround opening 50 through which materials can be loaded into the hopper car 10. In other words, the coaming 40 extends around the opening 50, defining an outer perimeter of the opening 50. The coaming 40 extends above the curved panel 30, and in particular extends from and above the upper surface of the curved panel 30. In the illustrated example, the upright portion 42 of the coaming 40 includes two semicircular end walls (not separately labeled) connected by two parallel spaced apart side walls (not separately labeled). The inner surface 46 of the coaming 40 is adjacent to the opening 50, thereby forming an oblong ring around the opening 50. The outer surface 48 of the coaming 40 is opposite the inner surface 46 of the coaming 40. The top surface 44 of the coaming 40 is opposite the top surface of the curved panel 30 and extends from the inner surface 46 to the outer surface 48. The top surface 44 is curved from the inner surface 46 to the outer surface 48. In other embodiments, the coaming includes an upper curved flange that defines the top surface of the coaming. The coaming 40 may be made from steel or any other suitable ferromagnetic material. It should be appreciated that the present disclosure may be employed with other suitably shaped coamings.

Referring now to FIGS. 2 to 20, one example top hatch cover 100 of the present disclosure is generally shown. The example illustrated hatch cover 100 generally includes: (1) an elongated movable hatch 200; (2) a plurality of spaced apart central hinges 300*a*, 300*b*, 300*c*, 300*d*, 300*e*, 300*f*, 300*g*, and 300*h* suitably connected to the hatch 200; (3) a first end hinge 400 suitably connected to a first end 202 of the hatch 200; (4) a second end hinge 500 suitably connected to an opposite second end 252 of the hatch 200; (5) a first actuator 600 suitably connected to the first end hinge 400 and the curved panel 30; and (6) a second actuator 700 suitably connected to the second end hinge 500 and the curved panel 30.

The hatch cover 100 is suitably attached to the roof 28, and more particularly to the curved panel 30 by the hinges 300*a* to 300*h*, 400 and 500. The hatch cover 100 is configured to securely engage and provide a magnetic seal with the coaming 40 when in a closed position (as shown in FIG. 12) and disengage from the coaming 40 and move to various open positions (such as shown in FIGS. 13, 14, 15, and 16 including a fully open position shown in FIG. 16). The hatch cover 200 is configured to move and particularly pivot between the fully open position and the closed position. Thus, the hatch cover 100 is configured to unseal and seal the hopper car 10 by moving from the fully open position to the closed position, and vice versa.

The elongated movable hatch 200 of the hatch cover 100 generally includes a first end 202 an opposite second end 252. The elongated movable hatch 200 includes: (1) an elongated flexible panel 210; and (2) an elongated oblong magnetic coaming sealer 250 connected to the bottom of the elongated flexible panel 210.

The elongated flexible panel 210 is generally rectangular, is larger than the coaming 40, and is larger than the opening 50. The panel 210 has a top surface (not labeled), a bottom surface (not labeled), a first side edge (not labeled), a second side edge (not labeled), a first end edge (not labeled), and a second end edge (not labeled). It should also be appreciated that the panel 210 is large enough relative to the coaming 40 such that when the elongated movable hatch 200 of the hatch cover 100 is in the closed position on the coaming 40, that the first side edge, the second side edge, the first end edge, and the second end edge each extend outwardly of the coaming 40. The panel 210 is made from a relatively light weight flexible material that is also semi-rigid in certain embodiments. In this example, the material of the panel 210 is made from a conveyor belt type material such as reinforced tarpaulin or a heavy duty plastic such as PVC. However, it should be appreciated that the material can be any other suitable material in accordance with the present disclosure. It should also be appreciated that the elongated panel can include one or more internal and/or external supporting members that provided a desired amount of support and rigidity to the material of the elongated panel in accordance with the present disclosure. It should also be appreciated that while this example panel 210 is made from one continuous section of material, the present disclosure contemplates that the panel 210 can be made from two or more sections that are suitably connected, and in certain such embodiments overlapping. It should also be appreciated that while this example panel 210 is made from one continuous layer of material, the present disclosure contemplates that the panel 210 can be made from two or more layers of material. It should also be appreciated that while this example panel 210 is rectangular, the present disclosure contemplates that the panel 210 can be made in other suitable shapes and sizes. It should be appreciated that the structure of the panel 210 is such that the panel 210 can be lifted from either end and that the flexible material will enable part of the elongated panel to be lifted without lifting the entire panel 210, and such that adjacent sections of the panel 210 can be sequentially lifted as further described below.

The elongated magnetic coaming sealer 250 includes a generally oval ring that is slightly wider than the top surface 44 of the coaming 40, and is larger than the opening 50. The magnetic coaming sealer 250 has a top surface (not labeled), a bottom surface (not labeled), an outer surface (not labeled), and an inner surface (not labeled). The magnetic coaming sealer 250 is suitably attached to the bottom of the elongated panel 210. In this example embodiment, the top surface of the sealer 250 is suitably attached to the bottom surface of the panel 210 (such as by bending or by using a suitable adhesive). The magnetic coaming sealer 250 includes two spaced apart-straight sections, and two spaced apart curved sections that respectively correspond to the two straight sections and two curved sections of the coaming 40. It should also be appreciated that the magnetic coaming sealer 250 is large enough relative to the coaming 40 such that when the elongated movable hatch 200 of the hatch cover 100 is in the closed position on the coaming 40, the bottom surface of the elongated magnetic coaming sealer 250 engages and seals the [entire] top surface 44 of the coaming 40. It should be appreciated that the magnetic coaming sealer 250 forms a magnetic connection with the metal and particularly steel coaming 44 when it engages the top surface 44 of the coaming 40. The magnetic coaming sealer 250 has a generally rectangular cross section that is approximately 576 inches (approximately 1463 cms) by 30 inches (approximately 76 cms). The magnetic coaming sealer 250 is made from a relatively light weight flexible magnetic-rubber material. In this example, the magnetic-rubber material of the magnetic coaming sealer 250 includes a mixture of ferrite powder and a rubber polymer resin; however, it should be appreciated that the magnetic material of the magnetic coaming sealer 250 can be any other suitable magnetic material in accordance with the present disclosure. It should also be appreciated that the magnetic coaming sealer 250 can include one or more internal and/or external supporting members that provide a desired amount of support and rigidity to the magnetic material of the magnetic coaming sealer 250 in accordance with the present disclosure. It should also be appreciated that while this example magnetic coaming sealer 250 is made from one continuous section of magnetic material, the present disclosure contemplates that the magnetic coaming sealer 250 can be made from two or more sections that are suitably connected, and in certain such embodiments overlapping. It should also be appreciated that while this example magnetic coaming sealer 250 is made from one continuous layer of magnetic material, the present disclosure contemplates that the magnetic coaming sealer can be made from two or more layers of material. It should be appreciated that the magnetic coaming sealer 250 is slightly compressible such that when it engages the top surface 44 of the coaming 40, it slightly compresses to assist in forming the seal with the coaming 40. It should also be appreciated that while this example sealer 250 oval (to align with, correspond to, and seal the oval coaming), the present disclosure contemplates that the sealer 250 can be made in other suitable shapes and sizes. It should be appreciated that the structure of the sealer 250 is such that the magnetic coaming sealer 250 can be lifted with the lifting of the panel 210 from either end and that the sealer 250 will enable part of the panel 210 to be lifted without lifting the entire panel 210 and such that adjacent sections of the panel 210 can be sequentially lifted as further described below. It should also be appreciated that the sealer 250 could alternatively include one or more sections that are configured to engage the inner or outer surfaces of the coaming 40 in accordance with the present disclosure.

As mentioned above, the hatch cover 300 includes spaced apart central hinges 300*a*, 300*b*, 300*c*, 300*d*, 300*e*, 300*f*, 300*g*, and 300*h* connected to the hatch 200. More specially, each of these central hinges 300*a*, 300*b*, 300*c*, 300*d*, 300*e*, 300*f*, 300*g*, and 300*h* is suitably connected to the elongated panel 210 as further discussed below. In this illustrated example embodiment, each of the central hinges 300*a*, 300*b*, 300*c*, 300*d*, 300*e*, 300*f*, 300*g*, and 300*h* is identical, and thus only central hinge 300*a* is discussed in detail for brevity. It should be appreciated that the central hinges 300*a*, 300*b*, 300*c*, 300*d*, 300*e*, 300*f*, 300*g*, and 300*h* do not need be identical in accordance with the present disclosure. It should also be appreciates that the quantity and spacing of the central hinges may vary in accordance with the present disclosure.

As best shown in FIGS. 9, 10, 17, 18, 19, and 20, the central hinge 300*a* generally includes: (1) a mounting bracket 310*a*; (2) a pivot pin bracket 320*a* suitably fixedly connected to the mounting bracket 310*a*; (3) a pivot pin assembly 330*a* suitably connected to the pivot pin bracket 320*a*; (4) a pivot arm 440*a* suitably pivotably connected to the pivot pin bracket 320*a* by the pivot pin assembly 330*a* and suitably fixedly connected to the elongated panel 210.

Figure 9:
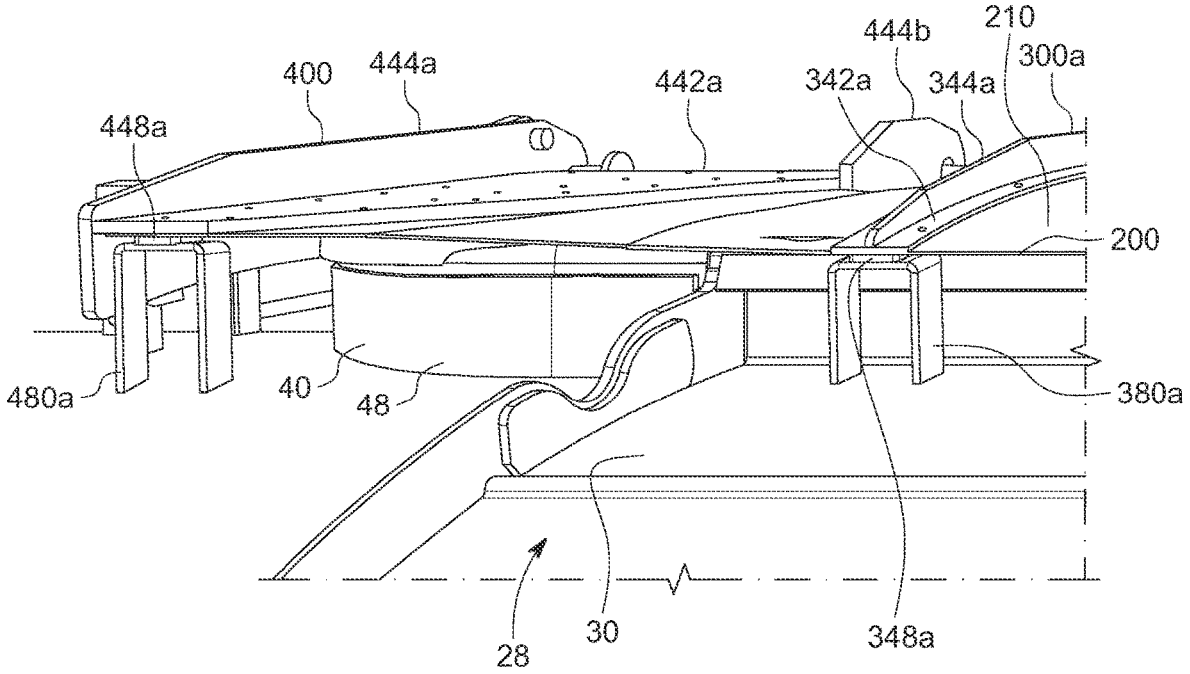
FIG. 9 is an enlarged fragmentary first side perspective view of the first end of the roof of the example hopper car of FIG. 1, and the first end of the top hatch cover of FIG. 2 shown attached to the first end of the roof of the hopper car, shown in the closed position, and shown with the first actuator of the hatch cover.
Figure 10:
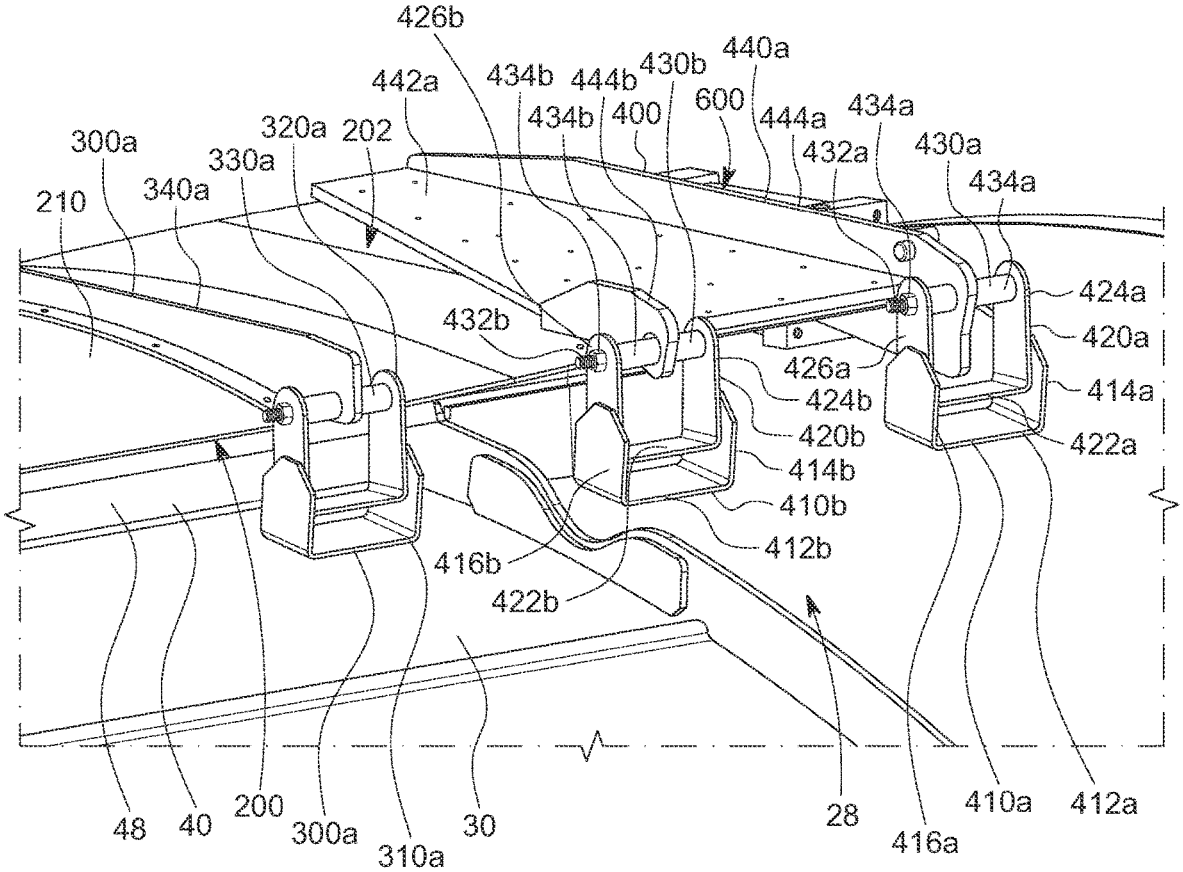
FIG. 10 is an enlarged fragmentary second side perspective view of the first end of the roof of the example hopper car of FIG. 1, and the first end of the top hatch cover of FIG. 2 shown attached to the first end of the roof of the hopper car, shown in the closed position, and shown with the first actuator of the hatch cover.
Figure 11:
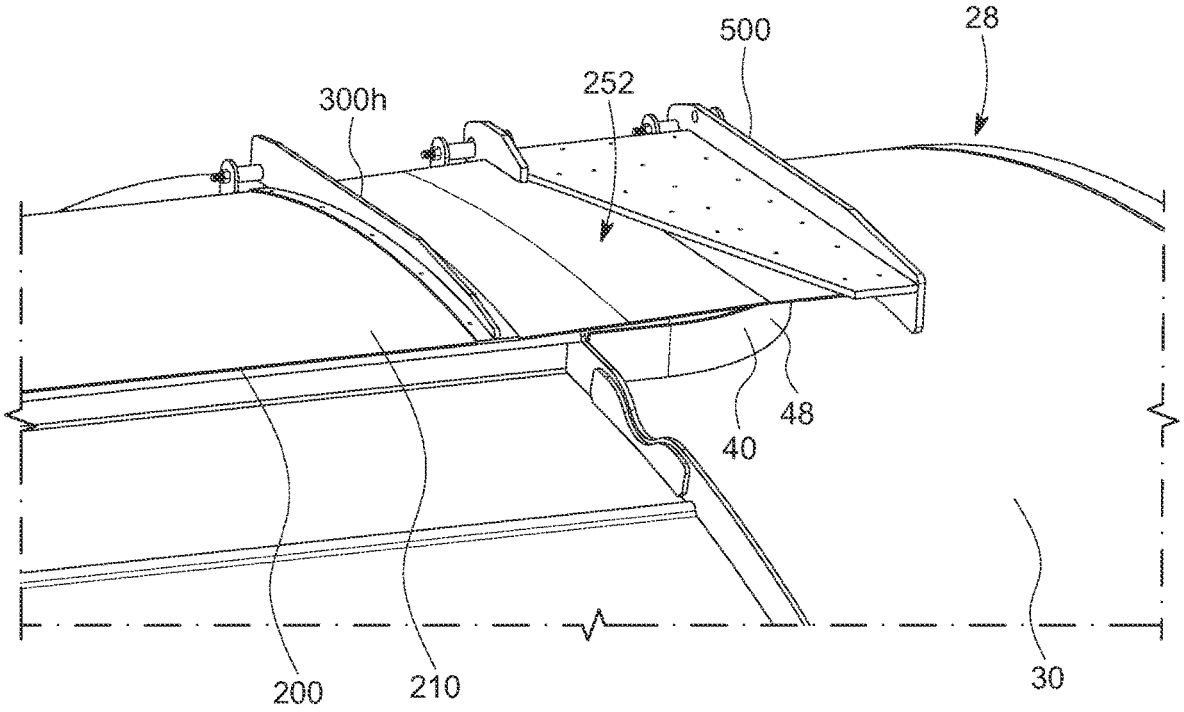
FIG. 11 is an enlarged fragmentary first side perspective view of the second end of the roof of the example hopper car of FIG. 1, and the second end of the top hatch cover of FIG.

The mounting bracket 310*a* includes: (1) a mounting base 312*a*; (2) a first mounting arm 314*a* integrally connected to and extending upwardly from the mounting base 312*a*; and (3) a second mounting arm 316*a* integrally connected to and extending upwardly from the mounting base 312*a*. The second mounting arm 316*a* is aligned with and spaced apart from the first mounting arm 314*a*. The mounting base 312*a* is suitably connected to the roof 28 and specifically to curved panel 30 of the roof 28 adjacent to the coaming 40 as best shown in FIGS. 9 and 10. The mounting bracket 310*a* is made of steel in this example embodiment. It should be appreciated that the mounting bracket 310*a* may be alternatively sized, configured, and made of different materials in accordance with the present disclosure.

The pivot pin bracket 320*a* includes: (1) a base 322*a*; (2) a first mounting arm 324*a* integrally connected to and extending upwardly from the base 322*a*; and (3) a second mounting arm 326*a* integrally connected to and extending upwardly from the base 322*a*. The second mounting arm 326*a* is aligned with and spaced apart from the first mounting arm 324*a*. The first mounting arm 324*a* is integrally connected to the first mounting arm 314*a* of the mounting bracket 310*a*. The second mounting arm 326*a* is integrally connected to the second mounting arm 316*a* of the mounting bracket 310*a*. The first mounting arm 324*a* defines an opening (not shown or labeled) for receiving part of the pivot pin assembly 330*a*. The second mounting arm 324*a* also defines an opening (not shown or labeled) for receiving part of the pivot pin assembly 330*a*. The openings of the first mounting arm 324*a* and the second mounting arm 324*a* are aligned. The pivot pin bracket 320*a* is mounted relative to the mounting bracket 310A to facilitate a suitable amount of clearance for pivoting and rotation of the pivot arm 440*a* relative to the roof 28 and specifically the curved panel 30 of the roof 28 and the coaming 40 of the roof 28. The pivot pin bracket 320*a* is made of steel in this example embodiment. It should be appreciated that the pivot pin bracket 320*a* may be alternatively sized, configured, and made of different materials in accordance with the present disclosure.

The pivot pin assembly 330*a* includes: (1) a bolt 332*a* that extends through the openings in first mounting arm 324*a* and the second mounting arm 326*a*; (2) a nut 334*a* connected to the bolt 332*a*; and (3) a collar 344*a* freely rotatably journaled about the bolt 332*a* between the first mounting arm 324*a* and the second mounting arm 326*a*. Although not shown, the pivot pin assembly 330*a* may include one or more suitable washers. The pivot pin assembly 330*a* is made of steel in this example embodiment. It should be appreciated that the pivot pin assembly 330*a* may be alternatively sized, configured, and made of different materials in accordance with the present disclosure.

The pivot arm 340*a* includes: (1) an elongated hatch connector base 342*a*; and (2) an elongated support wall 344*a* integrally connected to and upwardly extending from the elongated hatch connector base 342*a*. The hatch connector base 342*a* includes a bottom surface 343*a* that is positioned on the top surface of the elongated panel 210 of the hatch 200. The hatch connector base 342*a* includes a plurality of openings for suitable fasteners (not shown) for attaching the hatch connector base 342*a* to the panel 210. The support wall 344*a* adds structural support to the hatch connector base 342*a* and facilitates the rotation of the hatch 200. The hatch connector base 342*a* is integrally connected to the collar 344*a* of the pivot pin assembly 330*a*. Likewise, the support wall 344*a* is integrally connected to the collar 344*a* of the pivot pin assembly 330. This configuration enables the pivot arm 340*a* and the section of the panel 210 of the hatch 200 to pivot about the pivot pin assembly 330*a* and relative to the pivot pin bracket 320*a*, the coaming 40, and the roof 28. The pivot arm 340*a* is made of steel in this example embodiment. It should be appreciated that the pivot arm 340*a* may be alternatively sized, configured, and made of different materials in accordance with the present disclosure.

As best shown in FIG. 9, in this illustrated example embodiment, the pivot arm 340*a* also includes a pad 348*a* suitably connected to the bottom of the end portion of the hatch connector base 342*a* opposite the pivot pin assembly 330*a*. The pad 348*a* is configured to rest on a stand 380*a* connected to and extending upwardly from the roof 28 and specifically from the curved panel 30 of the roof 28 adjacent to the coaming 40. The stand 380*a* partially supports the pivot arm 340*a* and the hinge 300*a* when the hatch 200 is in the closed position as shown in FIG. 9. It should be appreciated that the present disclosure contemplates suitable stands such as stand 380*a* for each of the central hinges 300*a*, 300*b*, 300*c*, 300*d*, 300*e*, 300*f*, 300*g*, and 300*h*. The pad 348*a* is made of a magnetic material such as neodymium in this example embodiment. It should be appreciated that the pad 348*a* may be alternatively sized, configured, and made of different materials in accordance with the present disclosure. The stand 380*a* is made of steel or any other suitable ferromagnetic material in this example embodiment. The stand 380*a* is suitably connected to the roof 28 and specifically to curved panel 30 of the roof 28 adjacent to the coaming 40 as best shown in FIG. 9. It should be appreciated that the stands may be alternatively sized, configured, and made of different materials in accordance with the present disclosure.

As mentioned above, the hatch cover 100 includes the first end hinge 400 connected to a first end 202 of the hatch 200 and the second end hinge 500 connected to a second end 252 of the hatch 200. More specially, each of these hinges 400 and 500 is suitably connected opposite ends of the elongated panel 210 as further discussed below. In this illustrated example embodiment, each of the hinges 400 and 500 are mirror images of each other, and thus end hinge 400 is primarily discussed in detail for brevity. It should be appreciated that the end hinges 400 and 500 do not need be exact mirror images in accordance with the present disclosure.

As best shown in FIGS. 6, 7, 8, 9, and 10, the hinge 400 generally includes: (1) a first mounting bracket 410*a*; (2) a second mounting bracket 410*a*; (3) a first pivot pin bracket 420*a* suitably fixedly connected to the first mounting bracket 410*a*; (4) a second pivot pin bracket 420*b* suitably fixedly connected to the second mounting bracket 410*b*; (5) a first pivot pin assembly 430*a* suitably connected to the first pivot pin bracket 420*a*; (6) a second pivot pin assembly 430*b* suitably connected to the second pivot pin bracket 420*b*; and (7) a pivot arm 440 suitably pivotably connected to the first pivot pin bracket 420*a* by the pivot pin assembly 430*a*, suitably pivotably connected to the second pivot pin bracket 420*b* by the pivot pin assembly 430*b*, and suitably fixedly connected to the elongated panel 210 at the first end 202 of the hatch 200.

The mounting bracket 410*a* includes: (1) a mounting base 412*a*; (2) a first mounting arm 414*a* integrally connected to and extending upwardly from the mounting base 412*a*; and (3) a second mounting arm 416*a* integrally connected to and extending upwardly from the mounting base 412*a*. The second mounting arm 416*a*, is aligned with and spaced apart from the first mounting arm 414*a*. The mounting base 412*a* is suitably connected to the roof 28 and specifically to curved panel 30 of the roof 28 adjacent to the coaming 40 as best shown in FIGS. 9 and 10. The mounting bracket 410*a* is made of steel in this example embodiment. It should be appreciated that the mounting bracket 410*a* may be alternatively sized, configured, and made of different materials in accordance with the present disclosure.

The pivot pin bracket 420*a* includes: (1) a base 422*a*; (2) a first mounting arm 424*a* integrally connected to and extending upwardly from the base 422*a*; and (3) a second mounting arm 426*a* integrally connected to and extending upwardly from the base 422*a*. The second mounting arm 426*a* is aligned with and spaced apart from the first mounting arm 424*a*. The first mounting arm 424*a* is integrally connected to the first mounting arm 414*a* of the mounting bracket 410*a*. The second mounting arm 426*a* is integrally connected to the second mounting arm 416*a* of the mounting bracket 410*a*. The first mounting arm 424*a* defines an opening (not shown or labeled) for receiving part of the pivot pin assembly 430*a*. The second mounting arm 424*a* also defines an opening (not shown or labeled) for receiving part of the pivot pin assembly 430*a*. The openings of the first mounting arm 424*a* and the second mounting arm 424*a* are aligned. The pivot pin bracket 420*a* is mounted relative to the mounting bracket 410A to facilitate a suitable amount of clearance for pivoting and rotation of the pivot arm 440*a* relative to the roof 28 and specifically the curved panel 30 of the roof 28 and the coaming 40 of the roof 28. The pivot pin bracket 420*a* is made of steel in this example embodiment. It should be appreciated that the pivot pin bracket 420*a* may be alternatively sized, configured, and made of different materials in accordance with the present disclosure.

The pivot pin assembly 430*a* includes: (1) a bolt 432*a* that extends through the openings in first mounting arm 424*a* and the second mounting arm 426*a*; (2) a nut 434*a* connected to the bolt 432*a*; and (3) a collar 434*a* freely rotatably journaled about the bolt 432*a* between the first mounting arm 424*a* and the second mounting arm 426*a*. Although not shown, the pivot pin assembly 430*a* may include one or more suitable washers. The pivot pin assembly 430*a* is made of steel in this example embodiment. It should be appreciated that the pivot pin assembly 430*a* may be alternatively sized, configured, and made of different materials in accordance with the present disclosure.

The mounting bracket 410*b* includes: (1) a mounting base 412*b*; (2) a first mounting arm 414*b* integrally connected to and extending upwardly from the mounting base 412*b*; and (3) a second mounting arm 416*b* integrally connected to and extending upwardly from the mounting base 412*b*. The second mounting arm 416*b* is aligned with and spaced apart from the first mounting arm 414*b*. The mounting base 412*b* is suitably connected to the roof 28 and specifically to curved panel 30 of the roof 28 adjacent to the coaming 40 as best shown in FIGS. 9 and 10. The mounting bracket 410*b* is made of steel in this example embodiment. It should be appreciated that the mounting bracket 410*b* may be alternatively sized, configured, and made of different materials in accordance with the present disclosure.

The pivot pin bracket 420*b* includes: (1) a base 422*b*; (2) a first mounting arm 424*b* integrally connected to and extending upwardly from the base 422*b*; and (3) a second mounting arm 426*b* integrally connected to and extending upwardly from the base 422*b*. The second mounting arm 426*b*, is aligned with and spaced apart from the first mounting arm 424*b*. The first mounting arm 424*b* is integrally connected to the first mounting arm 414*b* of the mounting bracket 410*b*. The second mounting arm 426*b* is integrally connected to the second mounting arm 416*b* of the mounting bracket 410*b*. The first mounting arm 424*b* defines an opening (not shown or labeled) for receiving part of the pivot pin assembly 430*b*. The second mounting arm 424*b* also defines an opening (not shown or labeled) for receiving part of the pivot pin assembly 430*b*. The openings of the first mounting arm 424*b* and the second mounting arm 424*b* are aligned. The pivot pin bracket 420*b* is mounted relative to the mounting bracket 410*b* to facilitate a suitable amount of clearance for pivoting and rotation of the pivot arm 440*b* relative to the roof 28 and specifically the curved panel 30 of the roof 28 and the coaming 40 of the roof 28. The pivot pin bracket 420*b* is made of steel in this example embodiment. It should be appreciated that the pivot pin bracket 420*b* may be alternatively sized, configured, and made of different materials in accordance with the present disclosure.

The pivot pin assembly 430*b* includes: (1) a bolt 432*b* that extends through the openings in first mounting arm 424*b* and the second mounting arm 426*b*; (2) a nut 434*b* connected to the bolt 432*b*; and (3) a collar 434*b* freely rotatably journaled about the bolt 432*b* between the first mounting arm 424*b* and the second mounting arm 426*b*. Although not shown, the pivot pin assembly 430*b* may include one or more suitable washers. The pivot pin assembly 430*b* is made of steel in this example embodiment. It should be appreciated that the pivot pin assembly 430*b* may be alternatively sized, configured, and made of different materials in accordance with the present disclosure.

The pivot arm 440*a* includes: (1) an elongated hatch connector base 442*a*; (2) a first elongated support wall 444*a* integrally connected to and upwardly extending from the hatch connector base 442*a*; and (3) a second support wall 444*b* integrally connected to and upwardly extending from the elongated hatch connector base 442*a*. The elongated hatch connector base 442*a* includes a bottom surface that is positioned on the top surface of the panel 210 of the hatch 200. The hatch connector base 442*a* includes a plurality of openings for suitable fasteners (not shown) for attaching the hatch connector base 442*a* to the panel 210. The support wall 444*a* adds structural support to the hatch connector base 442*a* and facilitates the rotation of the hatch 200. The support wall 444*b* adds structural support to the hatch connector base 442*a* and facilitates the rotation of the hatch 200. The hatch connector base 442*a* is integrally connected to the collar 434*a* of the pivot pin assembly 430*a* and is integrally connected to the collar 434*b* of the pivot pin assembly 430*b*. The support wall 444*a* is integrally connected to the collar 434*a* of the pivot pin assembly 430*a*. The support wall 444*b* is integrally connected to the collar 434*b* of the pivot pin assembly 430*b*.

This configuration enables the pivot arm 442*a* and the section of the elongated panel 210 of the hatch 200 to pivot about the pivot pin assemblies 430*a* and 430*b* relative to the pivot pin brackets 420*a* and 420*b*, the coaming 40, and the roof 28. The pivot arm 440*a* is made of steel in this example embodiment. It should be appreciated that the pivot arm 4340*a* may be alternatively sized, configured, and made of different materials in accordance with the present disclosure.

As best shown in FIG. 9, in this illustrated example embodiment, the pivot arm 440*a* also includes a pad 448*a* suitably connected to the bottom of the end portion of the hatch connector base 442*a* opposite the pivot pin assembly 430*a*. The pad 448*a* is configured to rest on a stand 480*a* connected to and extending upwardly from the roof 28 and specifically from the curved panel 30 of the roof 28 adjacent to the coaming 40. The stand 480*a* partially supports the pivot arm 440*a* and the end hinge 400 when the hatch 200 is in the closed position as shown in FIG. 9. It should be appreciated that the present disclosure contemplates a suitable stand for the other end hinge 500 although not shown in FIG. 11. The pad 448*a* is made of magnetic material such as neodymium in this example embodiment. It should be appreciated that the pad 448*a* may be alternatively sized, configured, and made of different materials in accordance with the present disclosure. The stand 480*a* is made of steel or any other suitable ferromagnetic material in this example embodiment. The stand 480*a* is suitably connected to the roof 28 and specifically to curved panel 30 of the roof 28 adjacent to the coaming 40 as best shown in FIG. 9. It should be appreciated that these stands may be alternatively sized, configured, and made of different materials in accordance with the present disclosure.

As mentioned above, or as best shown in FIGS. 12 to 16, the hatch cover 300 includes the first actuator 600 connected at one end to the first end hinge 400 and at the other end to the curved panel 30 of the roof 28, and the second actuator (labeled 700 but not shown) connected at one end to the second end hinge 500 and at the other end to the curved panel 30 of the roof 28. More specially, in this illustrated example embodiment, each of the actuators 600 and 700 are mirror images of each other, and thus actuator 600 is primarily discussed in detail for brevity. It should be appreciated that the actuator 600 and 700 do not need be exact mirror images in accordance with the present disclosure.

The actuator 600 generally includes: (1) a mounting bracket 610*a*; (2) a powered cylinder assembly 620*a*; (3) an end hinge bracket 640*a*; and (4) a signal communication line (not shown) suitably connected to the powered cylinder assembly 620*a*. The mounting bracket 610*a* is suitably connected to the curved panel 30 of the roof 28 adjacent the coaming 40. The end hinge bracket 640*a* is suitably connected to the first end hinge 400 and specifically to the support wall 444*a* of the first end hinge 400. The powered cylinder assembly 620*a* is pivotally connected to the mounting bracket 610*a* and pivotally and slidingly connected to the end hinge bracket 640*a*. The powered cylinder assembly 620*a* is configured to receive control signals from a suitable controller (not shown) via the communication line (not shown). The actuator can be pneumatically powered, hydraulically powered, or electrically powered in various different embodiments. It should be appreciated that the powered cylinder assembly can be any suitable such assembly. It should also be appreciated that the actuators 620*a*, 600 and 700 may be alternatively configured or be alternative actuators in accordance with the present disclosure.

As mentioned above, the actuators 600 and 700 provide forces to move the hatch 200 from the closed position to the fully open position, and vice versa. In the illustrated embodiment, two actuators 600 and 700 are positioned adjacent to the first and second ends of the hatch 200. Each actuator 600 and 700 is coupled to the curved panel 30 of the roof 28 via an actuator bracket, and one or more fasteners, welds, or other attachment mechanisms (not labeled) in accordance with the present disclosure.

FIGS. 12, 13, 14, 15, and 16 illustrate part of the operation of the hatch cover 100. FIG. 12 illustrates the hatch cover 100 in a closed position. FIGS. 13, 14, and 15 illustrate the hatch cover 100 in partially open positions. FIG. 16 illustrates the hatch cover 100 in a fully open position.

In FIG. 12, the hatch cover 100 is positioned on the coaming 40 such that oval magnetic coaming sealer 250 is positioned on and forms a seal with the oval top surface 44 of the coaming 40. The magnetic coaming sealer 250 remains connected to the steel coaming 40 by the magnetic attraction force of the magnetic coaming sealer 250 to the steel coaming 40.

To move to the fully opened position, one or both of the actuators attached to the end hinges, such as the actuator 600 providing an opening force on the first end hinge 600 causing the first end of the hatch 100 to move upwardly and away from the coaming 40 at that end. As the actuator 600 continues to apply force to the first end hinge 600, the first end hinge 600 continues its movement (as shown in FIGS. 13, 14, and 15) and causes the section adjacent to the first end 202 to also move upwardly and away from the coaming 40. This process continues and in effect causes a peeling effect of the hatch 200 of the hatch cover 100 from the coaming 40. It should be appreciated that both actuator could cause this to occur simultaneously from both ends of the hatch cover 100 such that the unpeeling effect meets in the middle of the hatch and such that the central section of the hatch cover 100 is the last section to be lifted (or unpeeled) from the coaming 40.

To move to the closed position, one or both of the actuators attached to the end hinges, such as the actuator 600 provides a closing force on the first end hinge 600 causing the first end of the hatch 100 to move upwardly and then downwardly toward and onto the coaming 40 at first end 202.

It should be appreciated from the above that the sealer 250 and the actuator 600 and 700 co-act to secure the hatch cover 100 on the coaming and create a suitable seal with the coaming that prevents any contaminants from entering the hopper car.

It alternative embodiments of the present disclosure, the stands are pads that engage the stands are also magnetic and thus provide a further securement of the hatch cover when in the closed position. This can be employed, for example to further secure the hatch cover from opening due to winds such as cross winds.

It should be appreciated from the above that the present disclosure employs the fact that the magnetic sealer 250 provides a strong seal with the coaming and facilitates easy opening since the magnetic sealer 250 is weaker is sheer and thus allows for such sequential openings of the sections of the hatch cover 100 (i.e., allows for such peeling from either end to the other or from both ends).

In alternative embodiments of the present disclosure, one or more of the hinges can include a pivot assembly with a torsion shaft to synchronize or link the movement of some or all of the pivot arms.

It should be appreciated from the above that the present disclosure contemplates that the hatch cover can extend outwardly of relative to the coaming to provide drip edges outwardly of the coaming.

It alternative embodiments of the present disclosure, the magnetic sealer is mounted within the flexible panel of the hatch.

It alternative embodiments of the present disclosure, the magnetic sealer is mounted on the top surface of the flexible panel of the hatch.

It alternative embodiments of the present disclosure, the magnetic sealer includes two or more magnetic sealers mounted to the bottom surface, the top surface, or within the flexible panel of the hatch.

In alternative embodiments of the present disclosure, the sealer is mounted on the bottom surface of the flexible panel of the hatch with sections of steel or any suitable ferromagnetic material and the hatch combing is magnetized.

It will be understood that modifications and variations may be effected without departing from the scope of the novel concepts of the present invention, and it is understood that this application is to be limited only by the scope of the claims.

The invention claimed is:

1. A hopper railroad car hatch cover comprising:

a movable hatch including a flexible panel including first and second end sections and a plurality of sections including a center section between the first and second end sections, and including a coaming sealer connected to the flexible panel, the coaming sealer configured to engage and create a seal with a coaming of a roof of a railroad hopper car when the movable hatch is in a closed position on the coaming, the coaming including: (a) a first end wall extending upwardly from the roof at a position spaced inwardly of a first end of the roof of the railroad hopper car, (b) a second end wall extending upwardly from the roof at a position spaced inwardly of an opposite second end of the roof of the railroad hopper car, and (c) longitudinally extending side walls connecting the first end wall and the second end wall;

a first end hinge connected to a first end of the movable hatch;

a second end hinge connected to an opposite second end of the movable hatch;

a plurality of spaced apart central hinges connected to the movable hatch between the first end hinge and the second end hinge;

a powered first actuator connected to the first end hinge and connectable to the roof of the hopper railroad car at a position on the roof between the first end wall of the coaming and the first end of the roof; and a powered second actuator connected to the second end hinge and connectable to the roof of the hopper railroad car at a position on the roof between the second end wall of the coaming and the second end of the roof, wherein the movable hatch, the first end hinge, the second end hinge, and the plurality of spaced apart central hinges are arranged such that when the powered first actuator and the powered second actuator apply respective opening forces to the first end hinge and the second end hinge, the powered first actuator and the powered second actuator respectively cause the first and second end sections of the movable hatch to be lifted before the center section is lifted, and the powered first actuator, the powered second actuator, and the first and second end sections then cause the plurality of sections to be lifted successively toward the center section.

2. The hopper railroad car hatch cover of claim 1, wherein the flexible panel includes a reinforced tarpaulin.

3. The hopper railroad car hatch cover of claim 1, wherein the flexible panel includes a heavy duty plastic.

4. The hopper railroad car hatch cover of claim 1, wherein the flexible panel has a greater length than the length of the coaming, and the flexible panel has a greater width than the width of the coaming.

5. The hopper railroad car hatch cover of claim 1, wherein one of the central hinges includes: a mounting bracket, a pivot pin bracket fixedly connected to the mounting bracket, a pivot pin assembly connected to the pivot pin bracket, and a pivot arm pivotably connected to the pivot pin bracket by the pivot pin assembly and fixedly connected to the flexible panel.

6. The hopper railroad car hatch cover of claim 1, wherein the first end hinge includes a first mounting bracket, a second mounting bracket, a first pivot pin bracket fixedly connected to the first mounting bracket, a second pivot pin bracket fixedly connected to the second mounting bracket, a first pivot pin assembly connected to the first pivot pin bracket, a second pivot pin assembly connected to the second pivot pin bracket, and a pivot arm pivotably connected to the first pivot pin bracket by the first pivot pin assembly, pivotably connected to the second pivot pin bracket by the second pivot pin assembly, and fixedly connected to a first end of the flexible panel.

7. The hopper railroad car hatch cover of claim 1, wherein the powered first actuator includes a mounting bracket, a powered cylinder assembly, an end hinge bracket, and a signal communication line connected to the powered cylinder assembly.

8. The hopper railroad car of claim 1, wherein the railroad hopper car includes longitudinally extending spaced apart side walls, wherein the powered first actuator includes a first shaft extendable from a first cylinder in a direction transverse to the longitudinally extending spaced apart side walls, and the powered second actuator includes a second shaft extendable from a second cylinder in the direction transverse to the longitudinally extending spaced apart side walls.

9. A hopper railroad car comprising:

a frame;

spaced apart side walls supported by the frame;

spaced apart end walls supported by the frame;

a roof supported by the side walls, the roof including a panel and a coaming supported by and upwardly extending from the panel, the coaming partially defining an opening in the roof, the coaming including: (a) a first end wall extending upwardly from the roof at a position spaced inwardly of a first end of the roof of the railroad hopper car, (b) a second end wall extending upwardly from the roof at a position spaced inwardly of an opposite second end of the roof of the railroad hopper car, and (c) longitudinally extending side walls connecting the first end wall and the second end wall;

a movable hatch including a flexible panel including first and second end sections and a plurality of sections including a center section between the first and second end sections, and including a coaming sealer connected to the flexible panel, the coaming sealer configured to engage and create a seal with the coaming when the movable hatch is in a closed position on the coaming;

a first end hinge connected to a first end of the movable hatch;

a second end hinge connected to an opposite second end of the movable hatch;

a plurality of spaced apart central hinges connected to the movable hatch between the first end hinge and the second end hinge;

a powered first actuator connected to the first end hinge and connected to the roof at a position on the roof between the first end wall of the coaming and the first end of the roof; and a powered second actuator connected to the second end hinge and connected to the roof at a position on the roof between the second end wall of the coaming and the second end of the roof, wherein the movable hatch, the first end hinge, the second end hinge, and the plurality of spaced apart central hinges are arranged such that when the powered first actuator and the powered second actuator apply respective opening forces to the first end hinge and the second end hinge, the powered first actuator and the powered second actuator respectively to cause the first and second end sections of the movable hatch to be lifted before the center section is lifted, and the powered first actuator, the powered second actuator, and the first and second end sections then cause the plurality of sections to be lifted successively toward the center section.

10. The hopper railroad car of claim 9, wherein the flexible panel includes a reinforced tarpaulin.

11. The hopper railroad car hatch cover of claim 9, wherein the powered first actuator includes a first shaft extendable from a first cylinder in a direction transverse to the spaced apart side walls, and the powered second actuator includes a second shaft extendable from a second cylinder in the direction transverse to the spaced apart side walls.

12. A hopper railroad car hatch cover comprising:

a movable hatch including a flexible panel and a magnetic coaming sealer connected to the flexible panel, the magnetic coaming sealer configured to engage and create a seal with a coaming of a roof of a railroad hopper car when the movable hatch is in a closed position on the coaming;

a first end hinge connected to a first end of the movable hatch;

a second end hinge connected to an opposite second end of the movable hatch;

a plurality of spaced apart central hinges connected to the movable hatch between the first end hinge and the second end hinge;

a first actuator connected to the first end hinge and connectable to the roof of the hopper railroad car; and a second actuator connected to the second end hinge and connectable to the roof of the hopper railroad car, wherein the movable hatch, the first end hinge, the second end hinge, the plurality of spaced apart central hinges, the first actuator, and the second actuator are configured such that the movable hatch is liftable from the first end and the second end.

13. The hopper railroad car hatch cover of claim 12, wherein the magnetic coaming sealer includes a magnetic oval ring attached to a bottom surface of the flexible panel.

14. The hopper railroad car hatch cover of claim 12, wherein the magnetic coaming sealer is configured to engage a top surface of the coaming.

15. The hopper railroad car hatch cover of claim 12, wherein the magnetic coaming sealer is bonded to a bottom surface of the flexible panel.

16. The hopper railroad car hatch cover of claim 12, wherein the flexible panel and the magnetic sealer are configured to peel off the coaming in sections.

17. A hopper railroad car hatch cover comprising:

a movable hatch including a flexible panel and a coaming sealer connected to the flexible panel, the coaming sealer configured to engage and create a seal with a coaming of a roof of a railroad hopper car when the movable hatch is in a closed position on the coaming;

a first end hinge connected to a first end of the movable hatch;

a second end hinge connected to an opposite second end of the movable hatch;

a plurality of spaced apart central hinges connected to the movable hatch between the first end hinge and the second end hinge, wherein one of the hinge includes a pad configured to engage a stand extending upwardly from the roof of the hopper railroad car adjacent to the coaming;

a first actuator connected to the first end hinge and connectable to the roof of the hopper railroad car; and a second actuator connected to the second end hinge and connectable to the roof of the hopper railroad car, wherein the movable hatch, the first end hinge, the second end hinge, the plurality of spaced apart central hinges, the first actuator, and the second actuator are configured such that the movable hatch is liftable from the first end and the second end.

18. A hopper railroad car comprising:

a frame;

spaced apart side walls supported by the frame;

spaced apart end walls supported by the frame;

a roof supported by the side walls, the roof including a panel and a coaming supported by and upwardly extending from the panel, the coaming partially defining an opening in the roof;

a movable hatch including a flexible panel and a magnetic coaming sealer connected to the flexible panel, the magnetic coaming sealer configured to engage and create a seal with the coaming when the movable hatch is in a closed position on the coaming;

a first end hinge connected to a first end of the movable hatch;

a second end hinge connected to an opposite second end of the movable hatch;

a plurality of spaced apart central hinges connected to the movable hatch between the first end hinge and the second end hinge;

a first actuator connected to the first end hinge and connected to the roof; and a second actuator connected to the second end hinge and connected to the roof, wherein the movable hatch, the first end hinge, the second end hinge, the plurality of spaced apart central hinges, the first actuator, and the second actuator are configured such that the movable hatch is liftable from the first end and the second end.

19. The hopper railroad car of claim 18, wherein the magnetic coaming sealer includes a magnetic oval ring attached to a bottom surface of the flexible panel.

20. The hopper railroad car of claim 18, wherein the magnetic coaming sealer is configured to engage a top surface of the coaming.

21. The hopper railroad car of claim 18, wherein the magnetic coaming sealer is bonded to a bottom surface of the flexible panel.

* * * * *